US005463841A

United States Patent [19]

Hayakawa et al.

[11] Patent Number: 5,463,841

[45] Date of Patent: Nov. 7, 1995

[54] UNWRAPPING APPARATUS FOR STRETCH-WRAPPED LOAD AND SHRINK-WRAPPED LOAD

[75] Inventors: Katsumi Hayakawa, Tokyo; Masahiro Tsukuda, Takatsuki; Yukiyoshi Sato, Takatsuki; Junichi Tatewaki, Takatsuki; Kazuya Yamasaka, Takatsuki, all of Japan

[73] Assignee: Oji Seital Kaisha, Ltd., Tokyo, Japan

[21] Appl. No.: 375,579

[22] Filed: Jan. 19, 1995

[30] Foreign Application Priority Data

Jul. 4, 1994 [JP] Japan ..... 6-173155

[51] Int. Cl.[6] ..... B65B 43/26

[52] U.S. Cl. ..... 53/381.2; 53/492

[58] Field of Search ..... 53/381.1, 381.2, 53/492; 414/412

[56] References Cited

U.S. PATENT DOCUMENTS 4,050,223 9/1977 Stees et al. ..... 53/381.2

5,148,651 9/0992 Masuda et al. ..... 53/381.2

5,282,346 2/1994 Masuda et al. ..... 53/381.2

*Primary Examiner*—John Sipos

*Assistant Examiner*—Gene L. Kim

*Attorney, Agent, or Firm*—Burns, Doane, Swecker & Mathis

[57] ABSTRACT

An unwrapping apparatus for unwrapping a palletized load with a film wrapping articles. The apparatus includes at the front side thereof lower grippers and upper grippers to grip lower and upper edges of a film of the load, respectively, and a cutter unit for vertically cutting the front side of the gripped film. The lower grippers are movable in the direction toward and away from the load as well as in the direction parallel to the load conveying direction. The unwrapping apparatus includes at the rear side thereof a vertically movable carriage with a platen to stabilize the load and a pair of swing arms. The swing arms carry the upper grippers and can swing to spread and remove the film. The platen includes a Z-shaped suction groove to retain the film on the top of a load and a heat cutter extending along the suction groove to cut the film of the top of the load held by the suction groove, for unwrapping the shrink-wrapped load.

9 Claims, 27 Drawing Sheets

UNWRAPPING APPARATUS FOR STRETCH-WRAPPED LOAD AND SHRINK-WRAPPED LOAD

BACKGROUND OF THE INVENTION

1. Field of the Invention

The present invention relates to an unwrapping apparatus for unwrapping a load comprising a plurality of articles placed on a pallet and a film wrapping the articles, and in particular, the present invention relates to an improved unwrapping apparatus for unwrapping a stretch-wrapped or shrink-wrapped load including relatively light articles such as empty containers arranged in bulk on a pallet and stacked into a plurality of layers via separate sheets.

2. Description of the Related Art

Conventionally, a variety of empty containers, such as glass bottles, PET bottles, or metallic cans are delivered to a bottling plant, in the form of a palletized load in which containers are placed on a pallet in bulk and layered via separate sheets between the layers, and the load is shrink-wrapped or stretch-wrapped. Shrink-wrapping apparatuses and stretch-wrapping apparatuses that can automatically shrink-wrap or stretch-wrap empty containers are known.

Unwrapping apparatuses for automatically unwrapping a shrink-wrapped or stretch-wrapped palettized load are also known and disclosed in, for example, Japanese Unexamined Patent Publication (Kokai) Nos. 48-58995, 49-95788, 1-111642, and 2-166033.

However, a problem has been pointed out regarding the unwrapping apparatuses. When the shrink-wrapped or stretch-wrapped palettized load including light articles such as empty containers is unwrapped, the wrapped articles such as containers fall off from the separate sheet.

In the case of unwrapping the stretch-wrapped load, the elastic stretchable film is wound around the articles under tension. When the film is cut, the film is suddenly released from tension and immediately shrinks while it is in contact with the surfaces of the articles, with the result that the articles such as light and empty containers stacked in bulk via separate sheet are pulled and moved by the film and possibly fall off from the separate sheets. The U.S. Pat. No. 5,282,346, assigned to the same assignee as for the present case, proposes an unwrapping apparatus which can solve this problem.

This unwrapping apparatus comprises front and rear upright frames, lower grippers arranged on the front upright frame for gripping a lower edge of a film on the load, a cutter unit arranged on the front upright frame for vertical movement along the front upright frame for cutting the film, and a carriage arranged on the rear upright frame for vertical movement along the rear upright frame. The carriage has a platen for stabilizing the load while being unwrapped, and a pair of symmetrical swing arms are arranged on the carriage. Upper grippers are carried by the free ends of the swing arms for gripping an upper edge of the film, so that the film that is cut by the cutter unit and gripped by the upper grippers is spread and separated from the load during a swing motion of the swing arms.

This unwrapping apparatus, however, is adapted for the stretch-wrapped load and cannot be applied to the shrink-wrapped load, since the film in the shrink-wrapped load is shaped in an inverted cup to cover the articles with the open bottom of the film located under the pallet and the bottom rims of the film are bent to the underside of the pallet and caught by the pallet at the bottom corners thereof. A heat is applied to the film to establish the shrink-wrapping. If this unwrapping apparatus is to be used for unwrapping the shrink-wrapped load, the top of the film of the load and the bottom corners of the film must be cut prior to the unwrapping operation by the unwrapping apparatus.

Japanese Patent Application No. 6-211817, assigned to the same assignee as for the present case, proposes a preliminary film cutting device which can be mounted to or arranged as a preparatory device for the above-described unwrapping apparatus. In this device, the upper portion of one side of the shrink-wrapped load, that is to be cut by the unwrapping apparatus, the upper portions of two sides adjacent to said one side, and the bottom corners of the film are cut prior to the operation by the unwrapping apparatus.

However, this preliminary film cutting device also suffers from several problems. When the upper portion of the sides of the film of the shrink-wrapped load is cut, the top edge of the load is damaged. If the articles and the pallet are fastened by vertically surrounding bands, the bands may be severed, and the articles are loosened and cannot be stably conveyed to the unwrapping apparatus. Furthermore, even ven if the bottom corners of the film are cut, the lower portion of the film may sometimes be caught by the pallet and thus not completely separated from the pallet.

SUMMARY OF THE INVENTION

The object of the present invention is to provide an unwrapping apparatus by which a stretch-wrapped load as well as a shrink-wrapped load can be equally unwrapped and the wrapping film can be removed from the load, without the wrapped articles such as empty containers falling off from the load and without the other wrapping materials being damaged.

According to the present invention, there is provided an unwrapping apparatus for unwrapping a load i.e., cutting a film wrapping the articles and removing said film therefrom, the unwrapping apparatus comprising: front and rear upright frames arranged in a spaced relationship, the front and rear upright frames defining a first line extending therebetween and a second line perpendicular to the first line; means for conveying a load to be unwrapped at an unwrapping position between the front and the rear upright frames; lower grippers arranged on or near the front upright frame for gripping a lower edge of a film of the load; means for supporting the lower grippers for movement along the second line; a cutter unit arranged on the front upright frame for movement along the front upright frame for vertically cutting the film; a carriage arranged on the rear upright frame for movement along the rear upright frame and having a platen for stabilizing the load while being unwrapped, the platen having a front side near the front upright frame and a rear side near the rear upright frame; a suction groove arranged in the platen to retain the top of the film, the suction groove having at least a first portion arranged near the front side thereof in parallel to the second line and a second portion extending from the first portion toward the rear side thereof; a heat cutter arranged in the platen along the suction groove to cut the top of the film held by the suction groove; a pair of symmetrical swing arms arranged above the platen with pivot ends near the rear upright frame and free ends near the front upright frame; an upper gripper arranged on the free end of each of the swing arms for gripping an upper edge of the film, whereby the film that is cut by the cutter unit and gripped by the upper grippers is spread and separated from the load during a swing motion of the swing arms.

Preferably, two lower grippers are arranged on the front upright frame in a horizontally side by side relationship for gripping a lower edge of the film of the load to be unwrapped; the cutter unit being arranged on the front upright frame between two lower grippers and having two pairs of pinch rollers with one of each pair of pinch rollers positionable on the exterior side of the film and the other on the interior side of the film to grip the film therebetween, and a cutter arranged between the two pairs of pinch rollers; the carriage including a support portion extending parallel to the second line, the support portion carrying the swing arms; and wherein each of the lower grippers is movable toward and away from the load and comprising a stationary jaw and a movable jaw, the movable jaw being formed in a generally semi-circular shape having a notch and a piecing edge adjacent to the notch.

Preferably, suction means is arranged on or near the rear upright frame for pulling the rear bottom portions of the film to separate the latter from the load.

Preferably, a rear gripper is arranged onto the carriage near the pivot end of one of the swing arms for gripping an upper edge of the film of the load, a ring-shaped collecting guide for collecting the film therein that is removed from the load, a pusher for pushing the film into the collecting guide, and discharge nip rollers arranged on the outlet side of the collecting guide to continuously compress and discharge the film pushed into the collecting guide.

Preferably, a heatsealer is arranged onto the carriage to heatseal and join together a top cover and the film.

Preferably, the cutter unit is arranged on the front upright frame between the two lower grippers for upward and downward movement, the cutter unit comprising two pairs of pinch rollers with one of each pair of pinch rollers positionable on the exterior side of the film and the other on the interior side of the film to grip the film therebetween, and a cutter arranged between the two pairs of pinch rollers for cutting the film, the pinch rollers that are positionable on the exterior side of the film having a heater for heatsealing the film.

Preferably, an auxiliary film separating means is arranged near the pivot ends of the swing arms for separating the upper rear portions of the film while being unwrapped.

Preferably, each of the upper grippers comprises a pair of cooperation jaws which are independently movable in relation to each other.

BRIEF DESCRIPTION OF THE DRAWINGS

The other objects and features of the present invention will become more apparent from the following description of the preferred embodiments, with reference to the accompanying drawings, in which.

DESCRIPTION OF THE PREFERRED EMBODIMENTS

Figure 1:
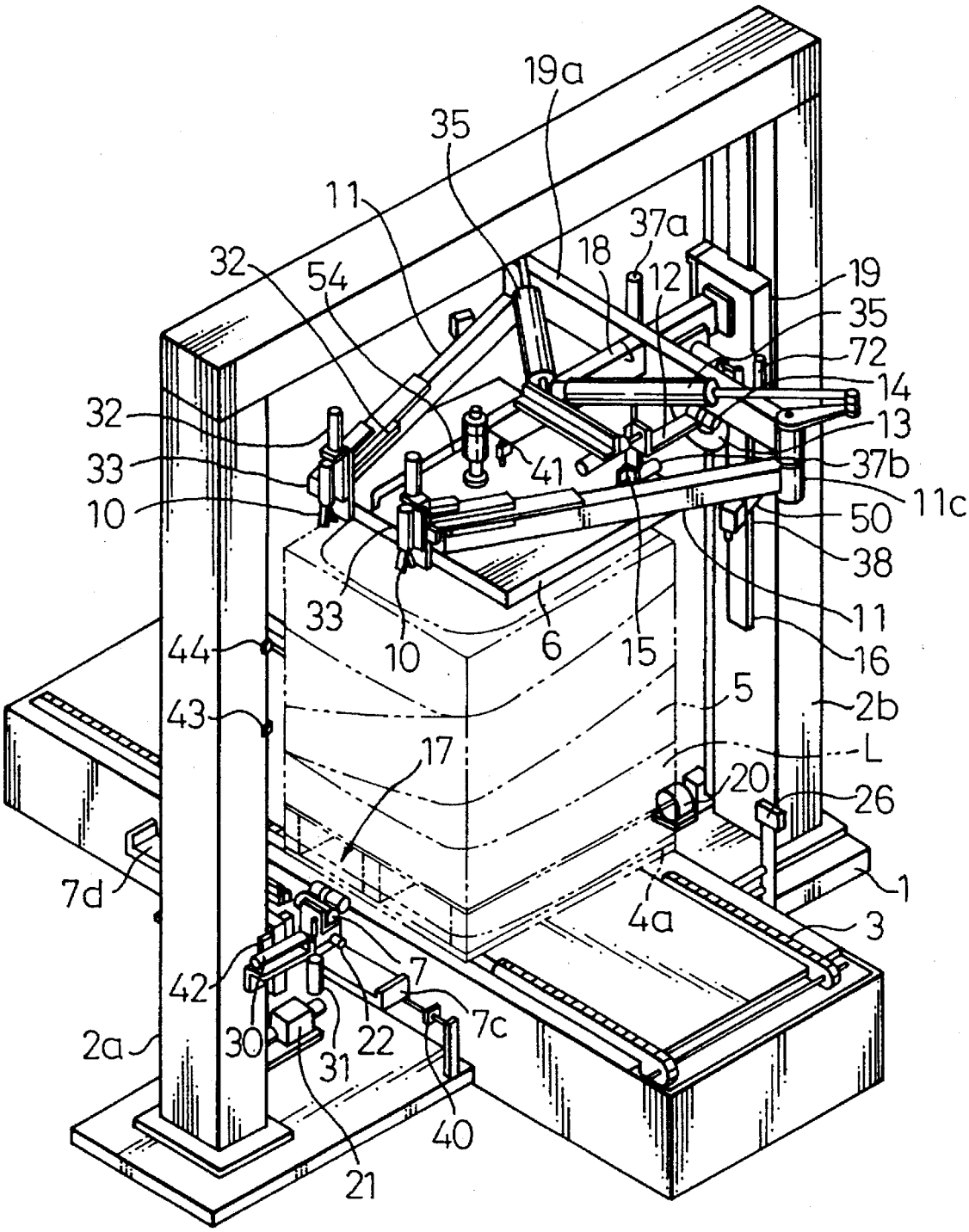
FIG. 1 is a perspective view of an unwrapping apparatus according to the first embodiment of the present invention.
Figure 2:
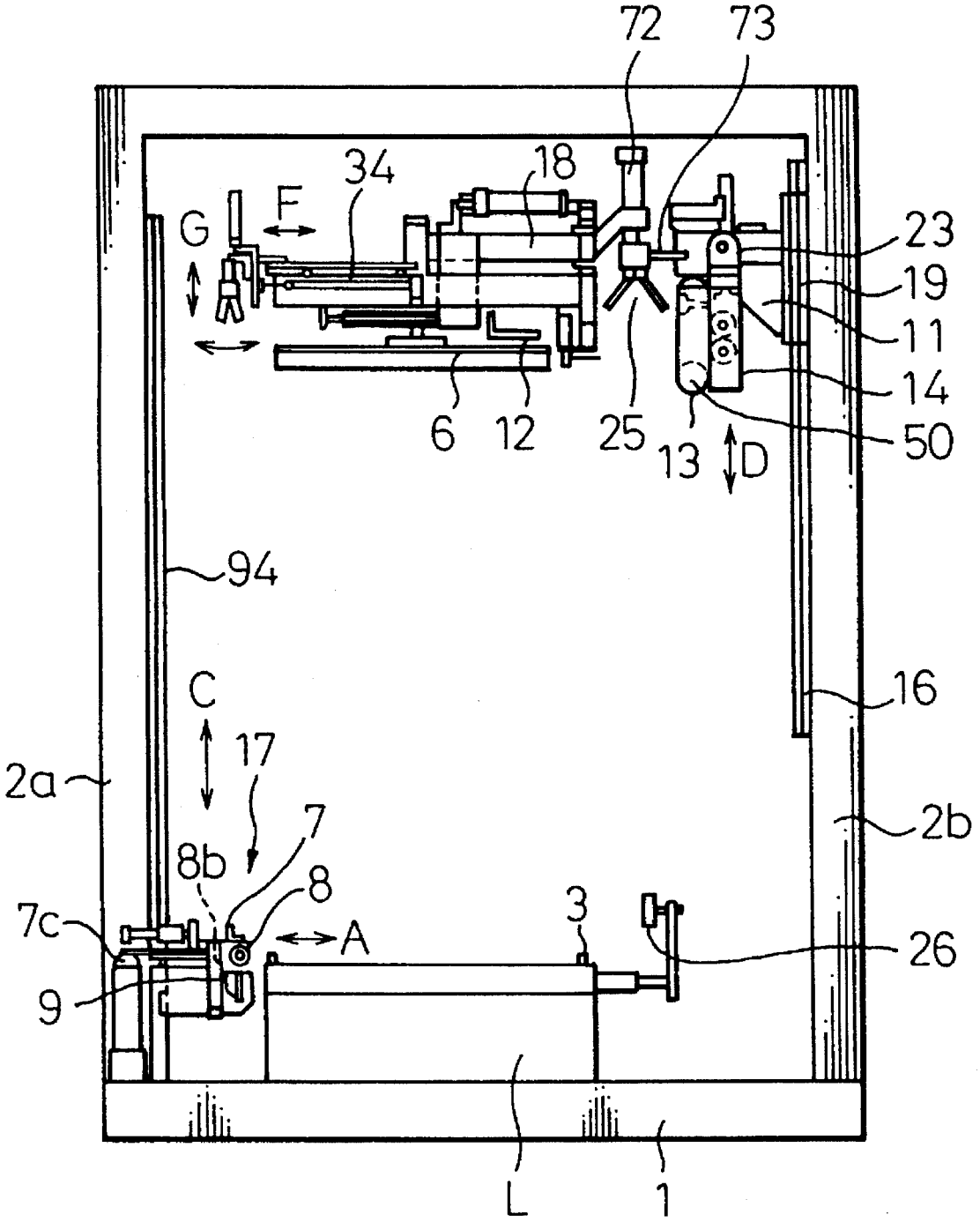
FIG. 2 is a side view of the unwrapping apparatus of FIG. 1.

FIG. 1 is an overall perspective view of an unwrapping apparatus according to the present invention and FIG. 2 is its elevational side view. The unwrapping apparatus is adapted to unwrap a stretch-wrapped load L, such as one shown in FIG. 23, or a shrink-wrapped load L, such as one shown in FIG. 24 or 25.

Figure 23:
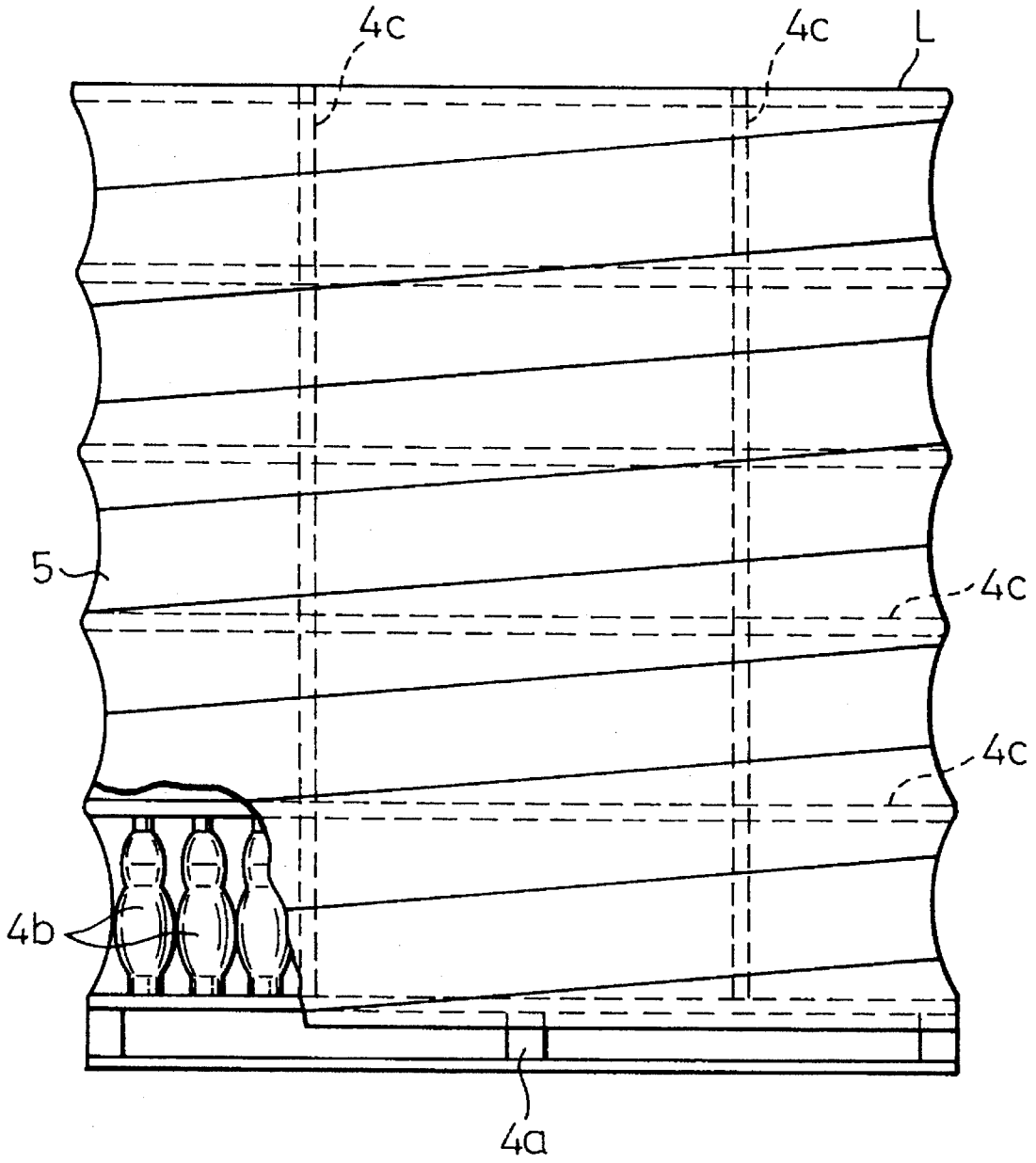
FIG. 23 is a side view of a stretch-wrapped load.

In FIG. 23, the stretch-wrapped load L comprises a pallet 4*a*, articles 4*b*, and a film 5 wrapping the articles 4*b* and the pallet 4*a* together under tension. In this example, the articles 4*b* are empty PET bottles which are placed on the pallet 4*a* in bulk via separate sheets 4*c* and bound by vertical straps 4*c*. The film 5 may contact the articles 4*b* at the peripheral region of the load L.

Figure 19:
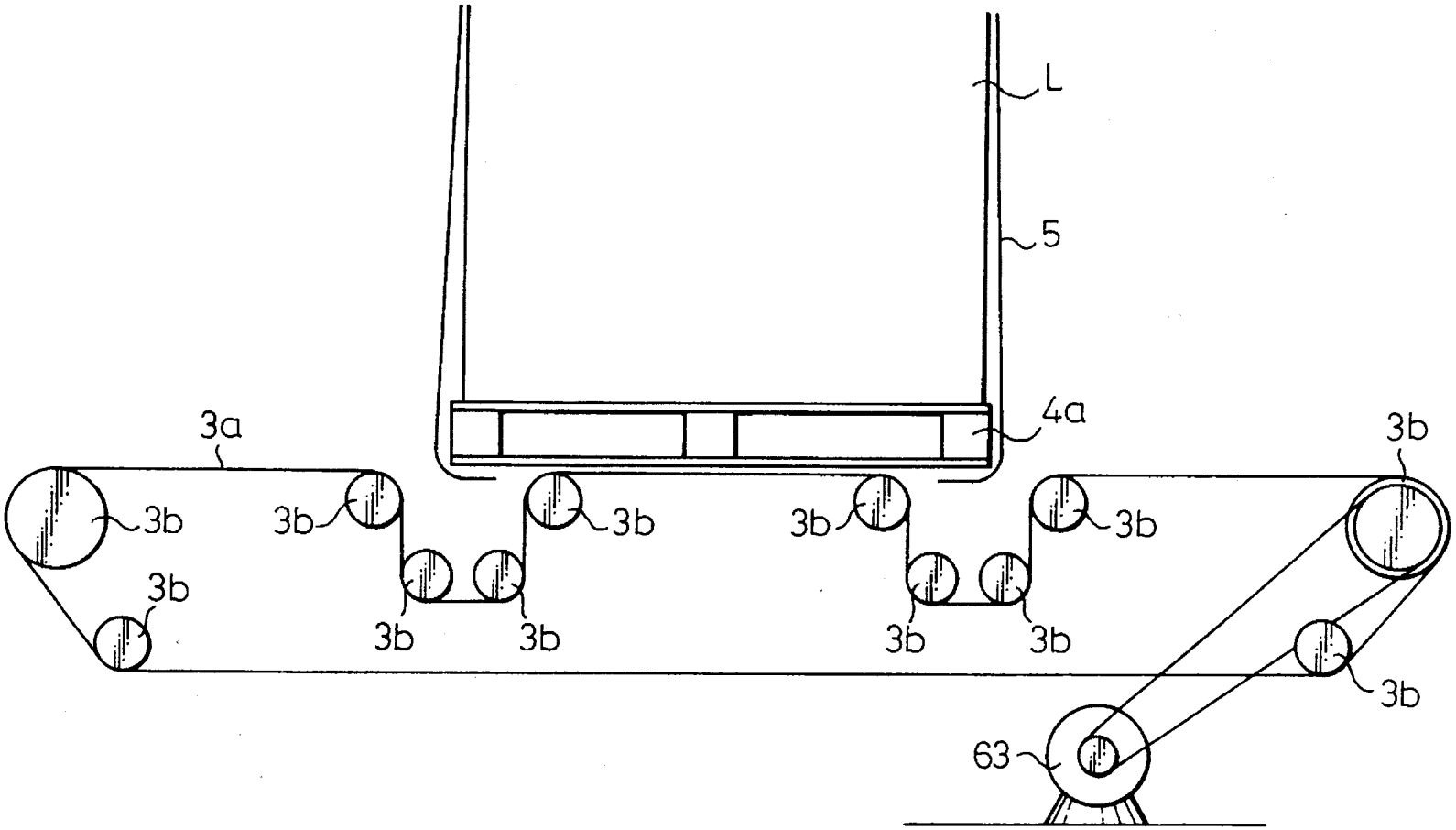
FIG. 19 is a side view of the conveyor.
Figure 24:
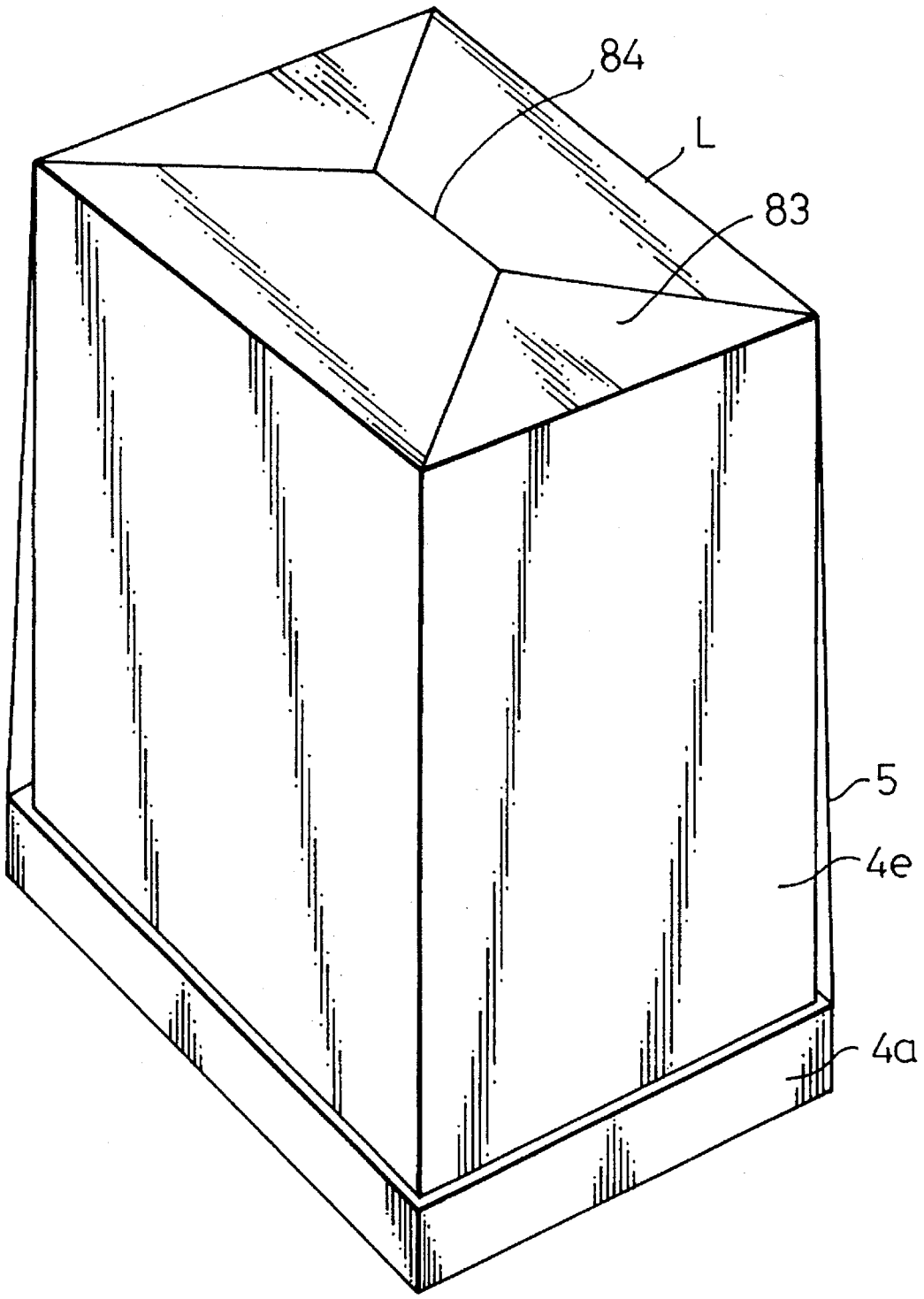
FIG. 24 is a perspective view of a shrink-wrapped load.
Figure 25:
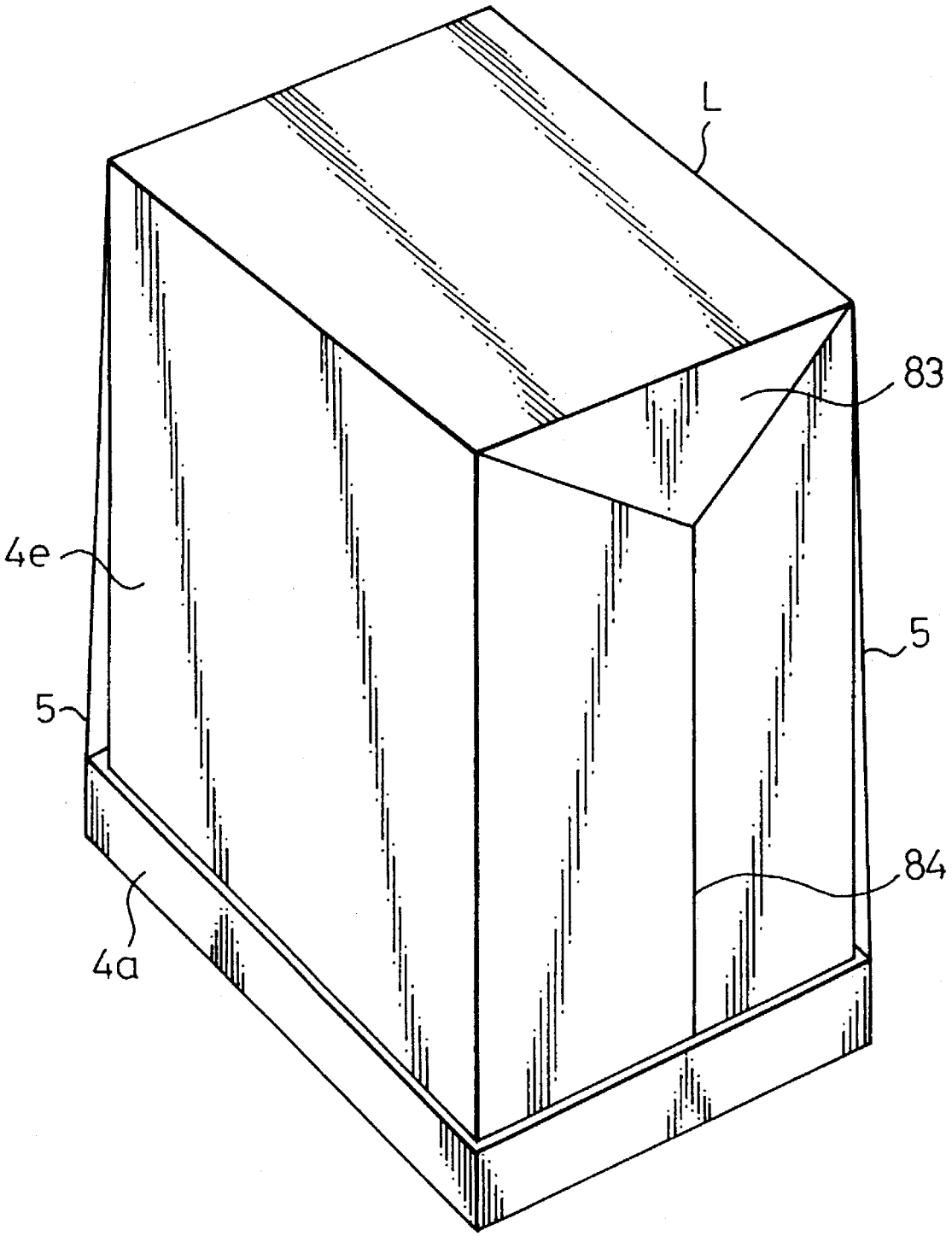
FIG. 25 is a perspective view of another shrink-wrapped load.
Figure 26:
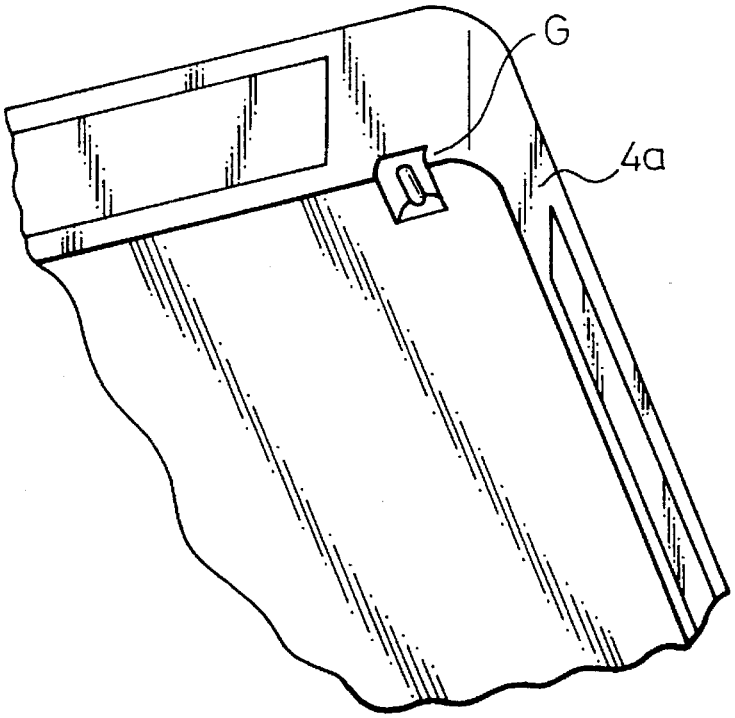
FIG. 26 is a bottom perspective view of a portion of a pallet used for the shrink-wrapped load.

In FIGS. 24 and 25, the shrink-wrapped load L comprises a pallet 4*a*, a group of articles 4*e*, and a film 5 covering the group of articles 4*e* accommodating the articles therein. The carton 4*e* has pivotable flaps 83 with edges 84. The film 5 is shaped in an inverted cup to cover the group of articles 4*e* with the open bottom of the film 5 located under the pallet 4*a*, and the lower portion of the film 5 is bent to the underside of the pallet 4*a*, as shown in FIG. 19 and caught by the bottom corners of the pallet 4*a*. A heat is applied to the film 5 to establish the shrink-wrapping. FIG. 26 shows a pallet 4*a* used in the shrink-wrapping, the pallet 4*a* having a cavity G at the bottom corner thereof by which the lower portion of the film is firmly caught. In this case, it may be rather difficult to remove the film from the load during the unwrapping operation.

Such a stretch-wrapped or shrink-wrapped L can be transported to a user, such as a beverage bottling plant, and unwrapped there by the unwrapping apparatus of the present invention.

Referring to FIGS. 1 and 2, the unwrapping apparatus includes a base frame 1, a front upright frame 2*a*, and a rear upright frame 2*b*. A chain conveyor 3 is provided on the base frame 1 for conveying the palletized load L to an unwrapping position between the front and rear upright frame 2*a* and 2*b*. The chain conveyor 3 comprises a pair of endless conveyor chains 3*a* running along pulleys 3*b* and driven by an electric motor 63, as shown in FIGS. 1 and 19. The distance between the conveyor chains 3*a* is narrower than the size of the load L, and some pulleys 3*b* are arranged in the position retracted from the conveying path so that the conveyer claims 3*a* do not interfere with removal of the film 5 from the leading and trailing bottom edges of pallet 4*a* during the unwrapping operation. Accordingly, there is a sufficient space around the bottom of the load L so that the lower portion of the film 5 extending to the underside of the pallet 4*a* can be removed from the bottom of the pallet 4*a*. It is, of course, possible to use other conveying means such as roller conveyors or a self propelled vehicle such as an AGV.

Figure 3:
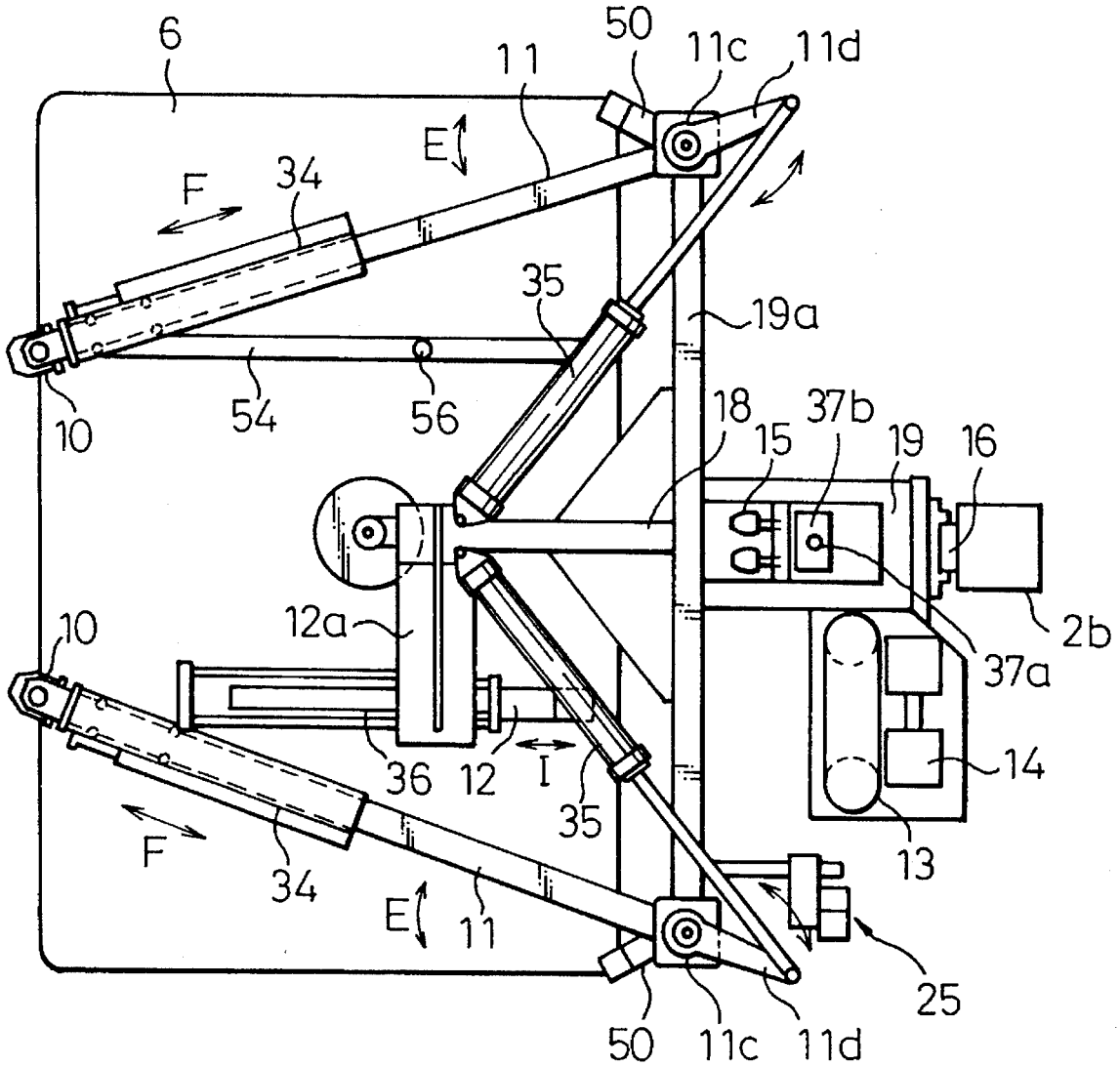
FIG. 3 is a plan view of the carriage, platen, and swing arms mounted to the rear upright frame of FIGS. 1 and 2.

The rear upright frame 2*b* has a vertical slide guide rail 16 at the inner side thereof, as shown in FIGS. 1 to 3. A carriage 19 is engaged with the vertical slide guide 16 and can vertically move along the rear upright frame 2*b*, as shown by the arrow D. An electric motor 20 moves the carriage 19 upwards and downwards via a chain or a belt. The carriage 19 has a swing arm support frame 19*a* fixed to the free end of the carriage 19 and extending parallel to the conveying direction of the conveyor 3. A platen arm 18 extends from the center of the swing arm support frame 19*a* perpendicular to the latter. The platen arm 18 supports a platen 6 which can press the top of the load L to stabilize the latter during unwrapping.

Figure 5:
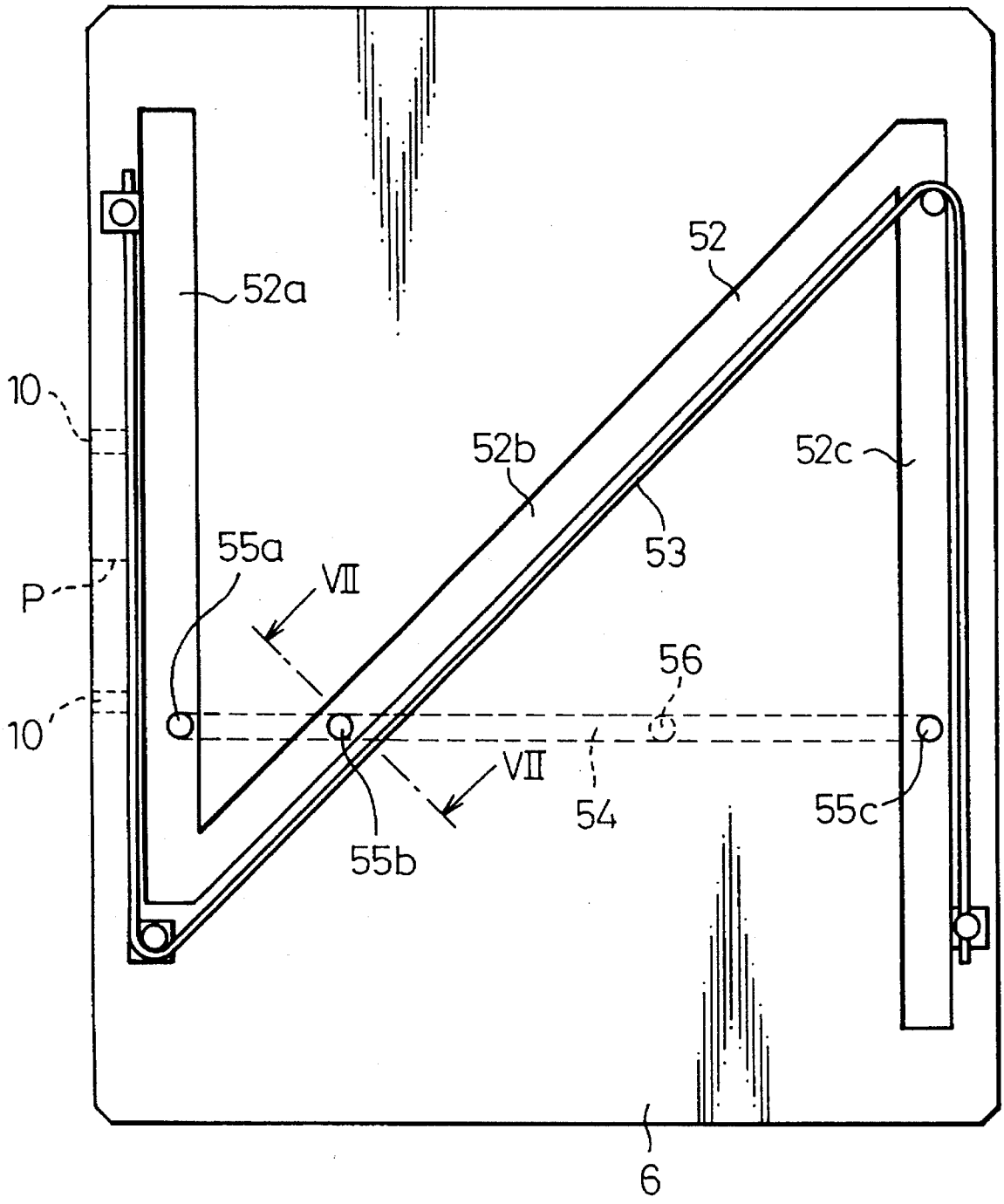
FIG. 5 is a bottom view of the platen of FIGS. 1 and 2.
Figure 6:
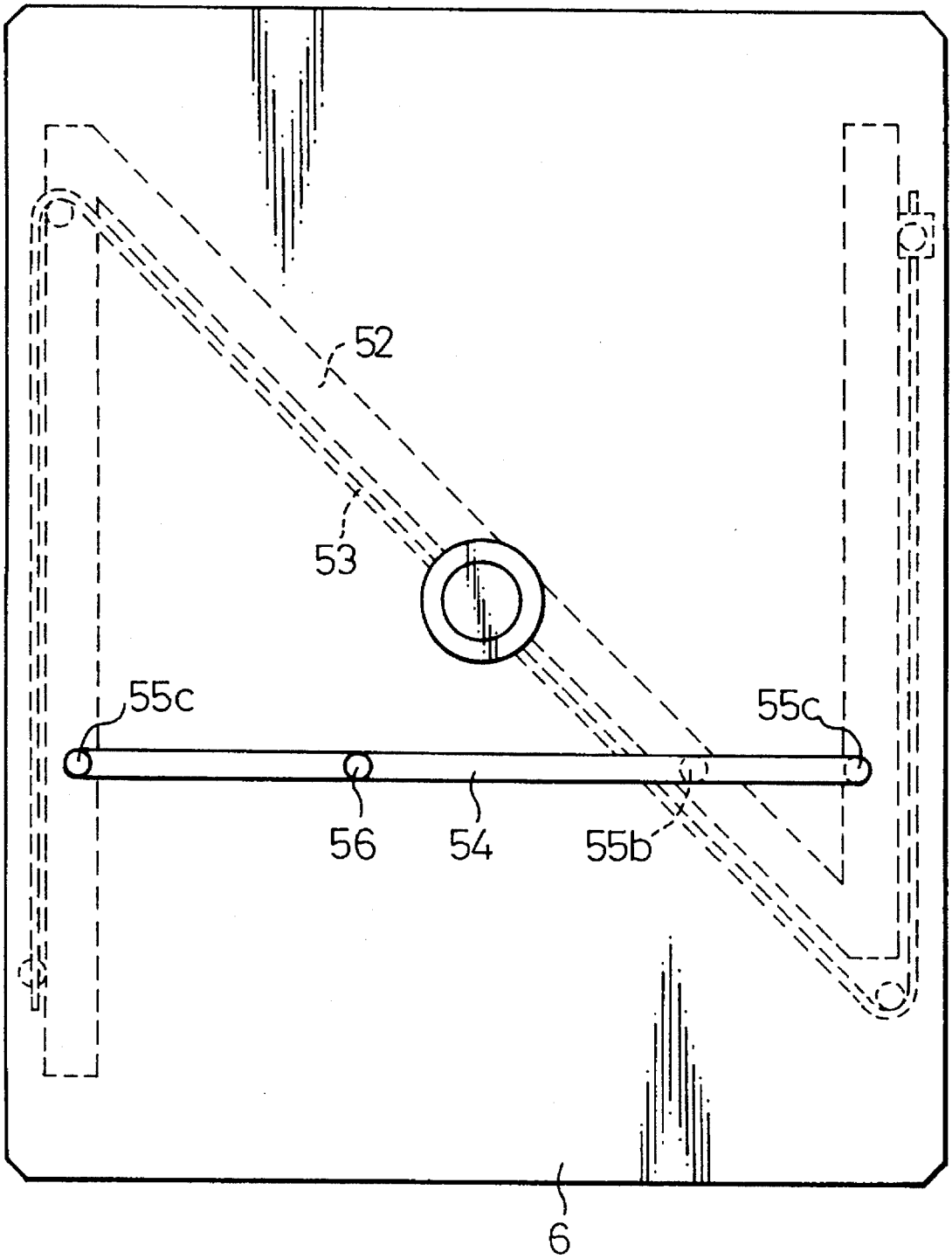
FIG. 6 is a plan view of the platen of FIG. 5.
Figure 7:
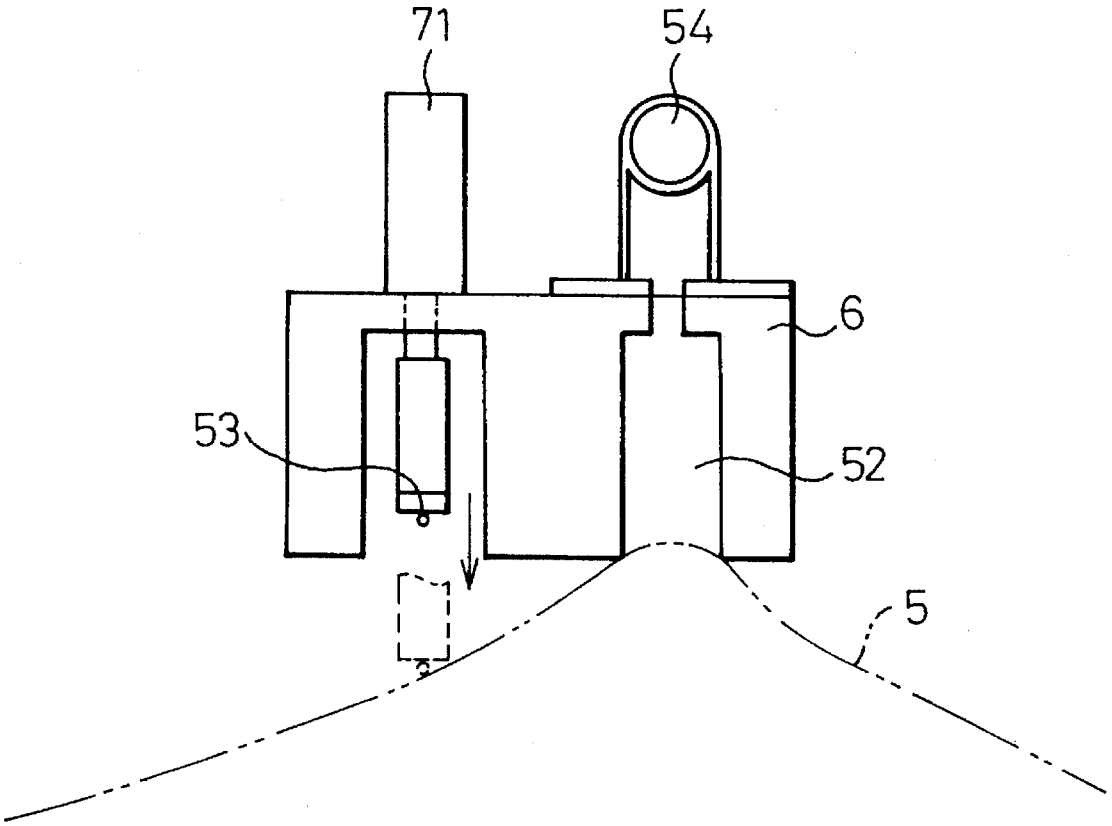
FIG. 7 is a diagrammatic cross-sectional view of the platen having the suction groove and the heat cutter, taken along the line VII—VII in FIG. 5.

As shown in FIGS. 5 to 7, the platen 6 has at its underside a Z-shaped suction groove 52 to retain the top of the film 5 and an electric heat cutter 53 arranged along the suction groove 52 in a side by side relationship to cut the top of the film 5 while the film 5 is retained by the suction groove 52. The Z-shaped suction groove 52 has a first portion 52*a* arranged near the front edge thereof parallel to the conveying direction of the conveyor 3 and extends along the substantial length of the platen 6, a second, oblique portion 52*b* extending from the first portion 52*a* toward the rear edge thereof, and a third portion 52*c* arranged near the rear edge thereof parallel to the first portion 52*a*. A suction pipe 54 is arranged on the platen 6 and suction holes 55*a* to 55*c* connect the suction pipe 54 to the suction groove 52. A suction hole 56 is provided in the suction pipe 54 for connecting the latter to a vacuum source such as a vacuum pump (not shown). The heat cutter 53 is movable relative to the platen 6, as shown by the arrow in FIG. 7, and a pneumatic cylinder 71 can move the heat cutter 53. The suction groove 52 and the heat cutter 53 are used when the shrink-wrapped load L is unwrapped, but not used when the stretch-wrapped load is unwrapped.

Figure 27:
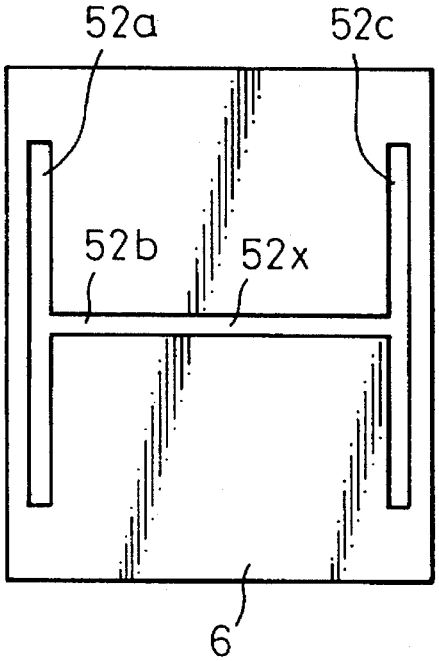
FIG. 27 is a bottom view of a modified platen.
Figure 28:
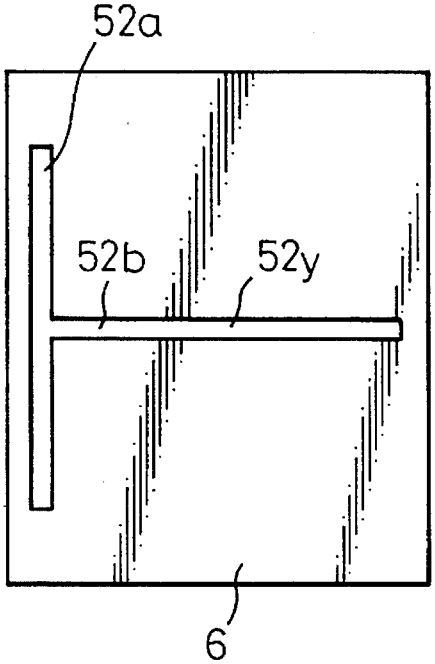
FIG. 28 is a bottom view of a further modified platen.

It is possible to modify the groove 52 into other shapes. For example, the modified platen 6 can have an H-shaped groove 52*x*, as shown in FIG. 27, or a T-shaped groove 52*y*, as shown in FIG. 28.

The swing arm support frame 19*a* is located slightly behind the load L to be unwrapped, as shown in FIGS. 1 and 3. A pair of main swing arms 11 are symmetrically arranged on the ends of the swing arm support frame 19*a* via pivots 11*c*. The main swing arms 11 extend toward the front upright frame 2*a* and the free ends thereof carry upper grippers 10 for gripping the upper edge of the film 5 of the load L to be unwrapped. Pivot levers 11*d* are associated with the main swing arms 11 and pneumatic cylinders 35 are provided to move the main swing arms 11 relative to the swing arm support frame 19*a*, as shown by the arrow E. Since the pneumatic cylinders 35 include commercially available proportional control valves, it is possible not only to infinitely select the speed of the swing motion but also to change the speed of the swing motion. It is also possible to temporarily stop the swing motion of the main swing arms 11 as desired.

Figure 8:
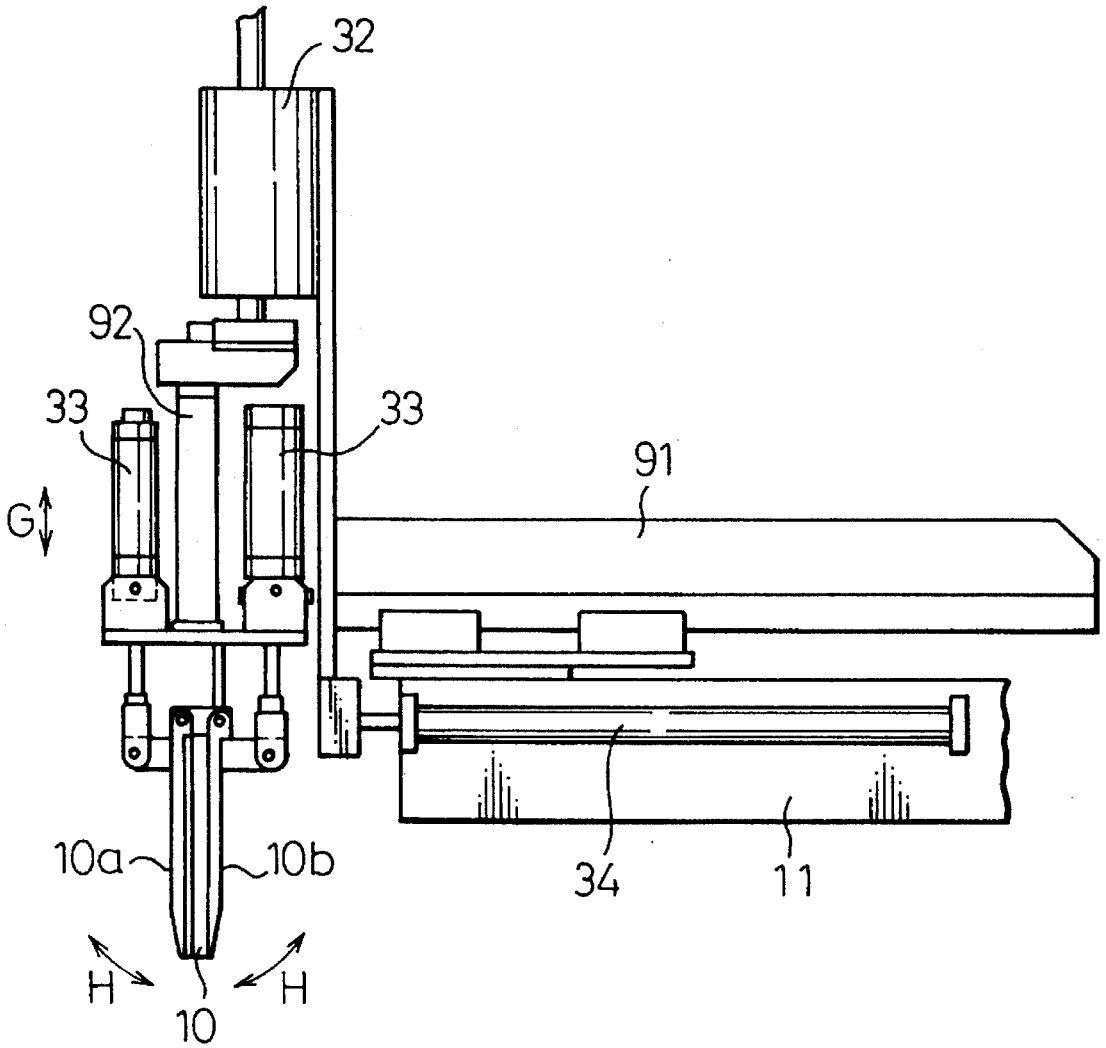
FIG. 8 is an enlarged side view of the upper gripper mounted to the swing arm.

As shown in FIGS. 2, 3, and 8, each of the upper grippers 10 is attached to the respective main swing arm 11 via a slidable gripper plate 91 and a slidable elevator plate 92, and thus movable toward and away from the load L, as shown by the arrow F, and upward and downward, as shown by the arrow G. Pneumatic cylinders 34 are associated with the slidable gripper plates 91, and pneumatic cylinders 32 are associated with the elevator plates 92, for this purpose. Each of the upper grippers 10 comprises a pair of cooperating jaws 10*a* and 10*b*, which are independently moved by pneumatic cylinders 33 to open and close the upper gripper 10 for a gripping action, as shown by the arrow H.

A pair of auxiliary swing arms 50 are provided on the swing arm support frame 19*a* near the pivot 11*c* of the main swing arms 11, as shown in FIGS. 1, 3, 9A and 9B. Each of the auxiliary swing arms 50 has a length shorter than that of the main swing arm 11 and carries a vertically movable pin 51. A pneumatic rotary actuator 39 is provided to cause the auxiliary swing arm 50 to swing. The pin 51 is attached to a piston of a pneumatic cylinder 38 fixed to the auxiliary swing arm 50 and is capable of moving vertically. The pin 51 of the auxiliary swing arm 50 can engage with the film 5 at two upper rear corners of the load L to assist the function of the main swing arms 11.

Figure 10:
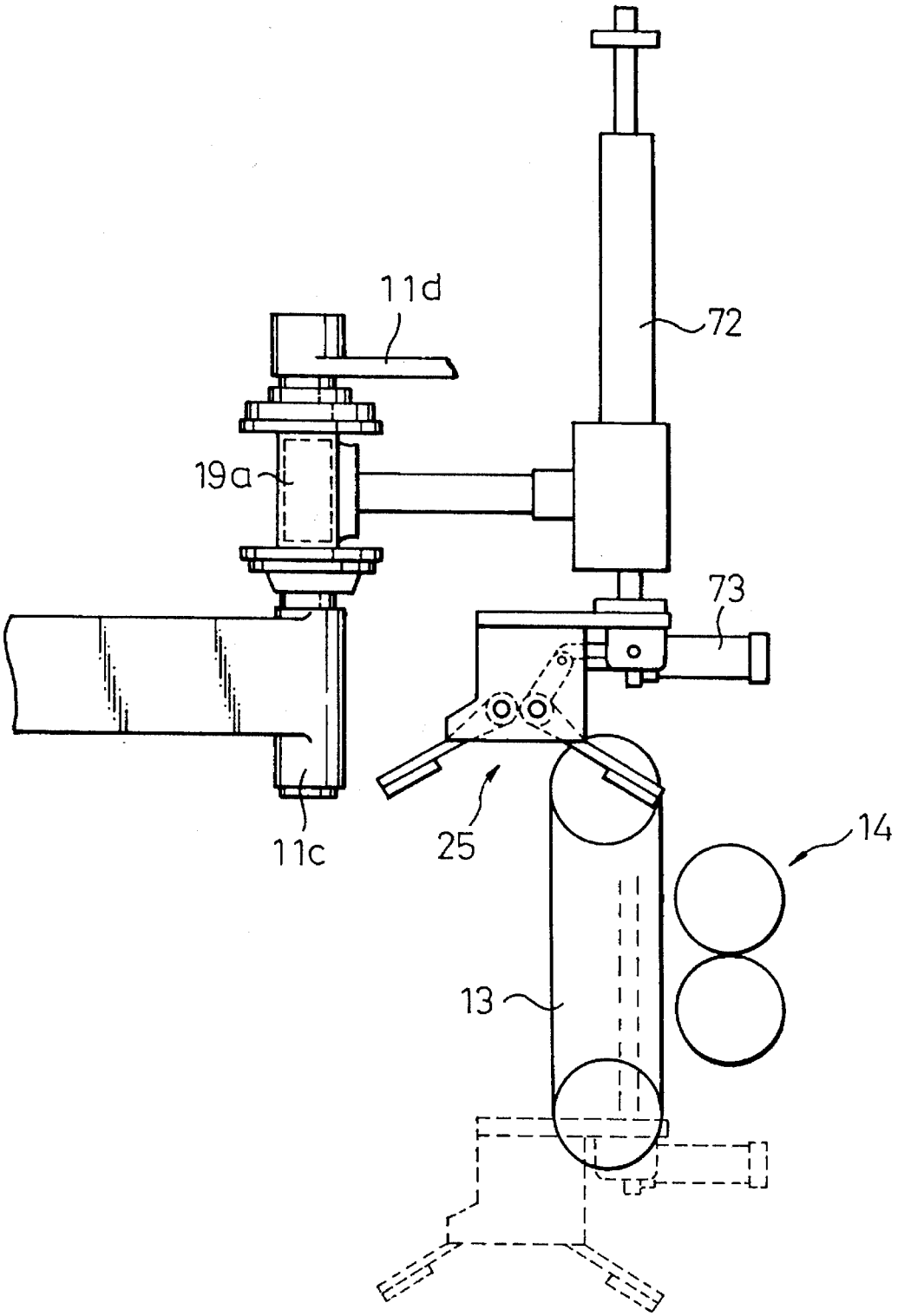
FIG. 10 is a side view of the rear gripper and the film collecting guide.
Figure 11:
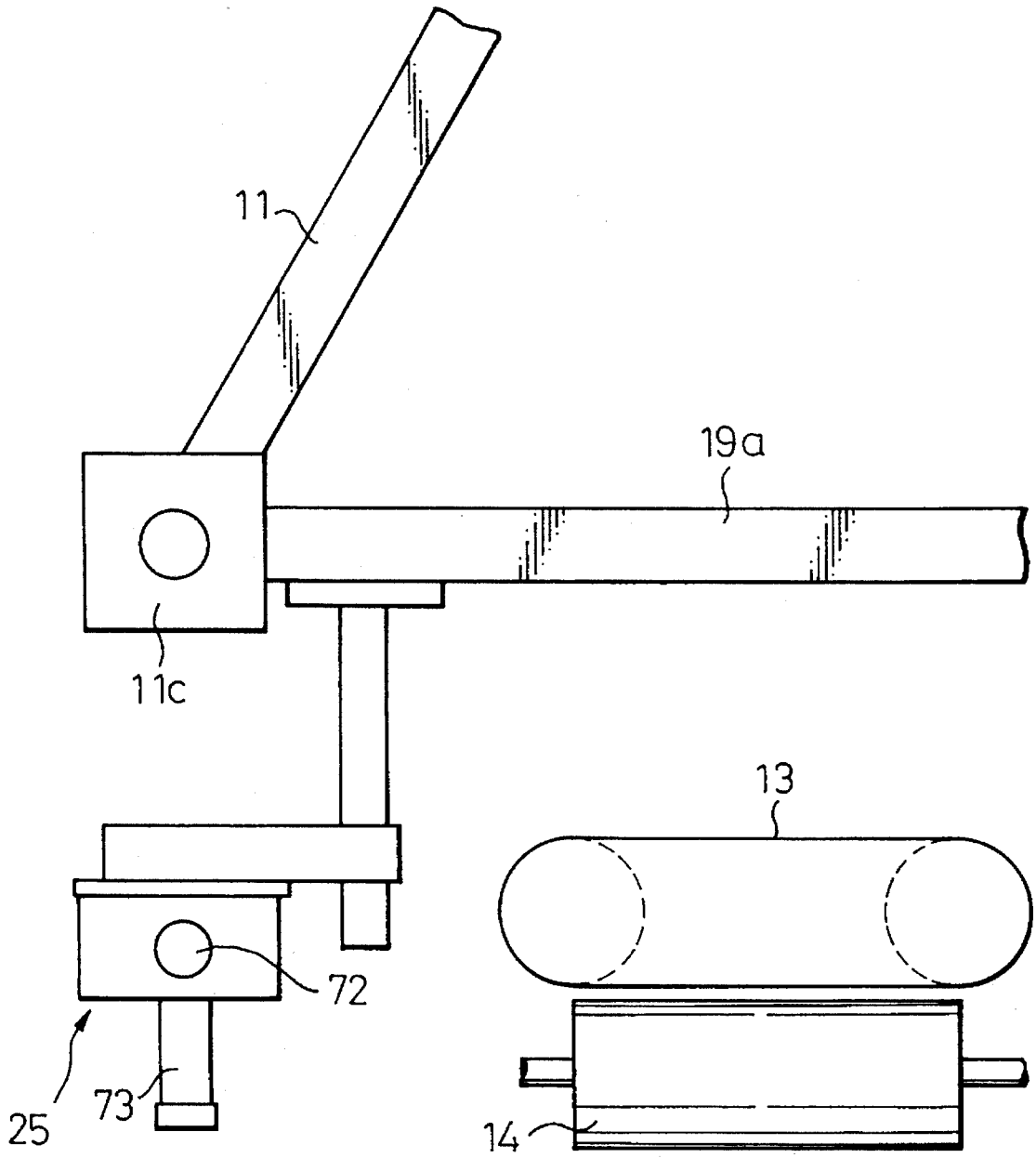
FIG. 11 is a plan view of the rear gripper and the film collecting guide of FIG. 10.

A rear gripper 25 is carried by the swing arm support frame 19*a* via a bracket extending from the rear surface of the swing arm support frame 19*a*, as shown in FIGS. 3, 10 and 11. The rear gripper 25 is vertically moved by a pneumatic cylinder 72 and moved by a pneumatic cylinder 73 for the gripping action, whereby the rear gripper 25 can grip the upper rear portion of the film 5 when the latter is cut and separated from the load L.

A discharge pusher 12 is arranged near the rear gripper 25, above the platen 6 and below the swing arm support frame 19*a*, and carried by the platen arm 18 via a bracket 12*a*. The discharge pusher 12 is attached to a piston rod of a horizontal pneumatic cylinder 36, and is movable toward and away from the swing arm support frame 19*a*, as shown by the arrow I in FIG. 3. The carriage 19 carries a ring-like collecting guide 13 arranged in alignment with the pusher 12, the collecting guide 13 having a circular or trumpet-shaped opening into which the pusher 12 can be inserted for pushing the removed film 5 into the collecting guide 13 as soon as the the film 5 is cut and separated from the load L. The collecting guide 13 thus collects the used film 5 to change its shape into a belt-like shape. In addition, a pair of discharge nip rollers 14 are arranged on the outlet side of the collecting guide 13 to continuously compress and discharge the film 5.

An impulse heatsealer 15 is also carried by the carriage 19. The carriage 19 supports a vertical pneumatic cylinder 37*a* having a piston rod which in turn carries a horizontal pneumatic cylinder 37*b*. The heatsealer 15 is attached to the piston rod of the horizontal pneumatic cylinder 37*b*. Therefore, the heatsealer 15 can be moved upward and downward, and toward and away from the load L. The heatsealer 15 can engage with a portion of the film 5 on the back of the load L, to heatseal and join together a plurality of turned layers of the film 5. If a top cover is applied to the load L, the heatsealer 15 can join the top cover and the film 5 together to discharge them together through the pusher 12, the collecting guide 13 and the discharge nip rollers 14.

Figure 15:
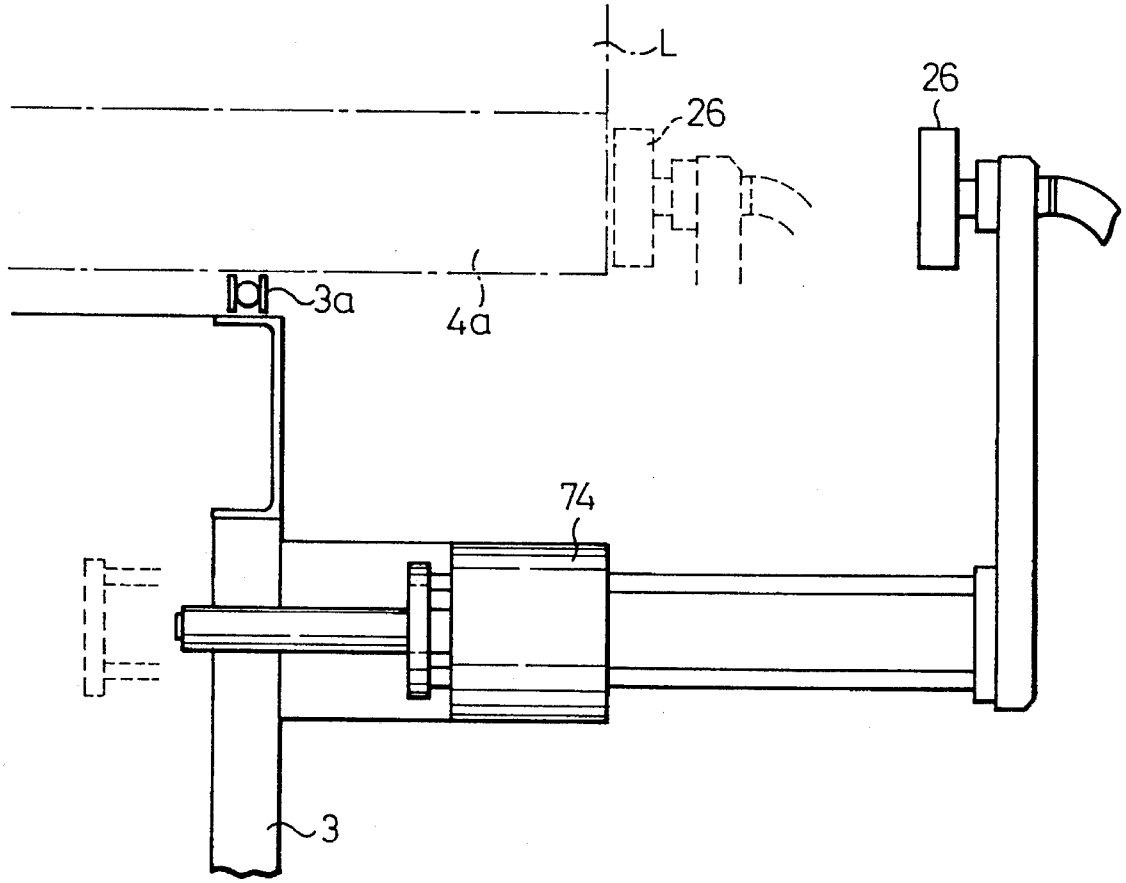
FIG. 15 is a side view of the rear suction cup.

Further, rear suction pads 26 are arranged on or near the rear upright frame 2*b* for pulling the rear bottom portions of the film 5 to separate the latter from the pallet 4*a*, as shown in FIGS. 1 and 15. The rear suction pads 26 are carried by piston rods of pneumatic cylinders 74 and are moved toward and away from the rear of the pallet 4*a*. In the embodiment, the pneumatic cylinders 74 are attached to the frame member of the chain conveyor 3.

Figure 4:
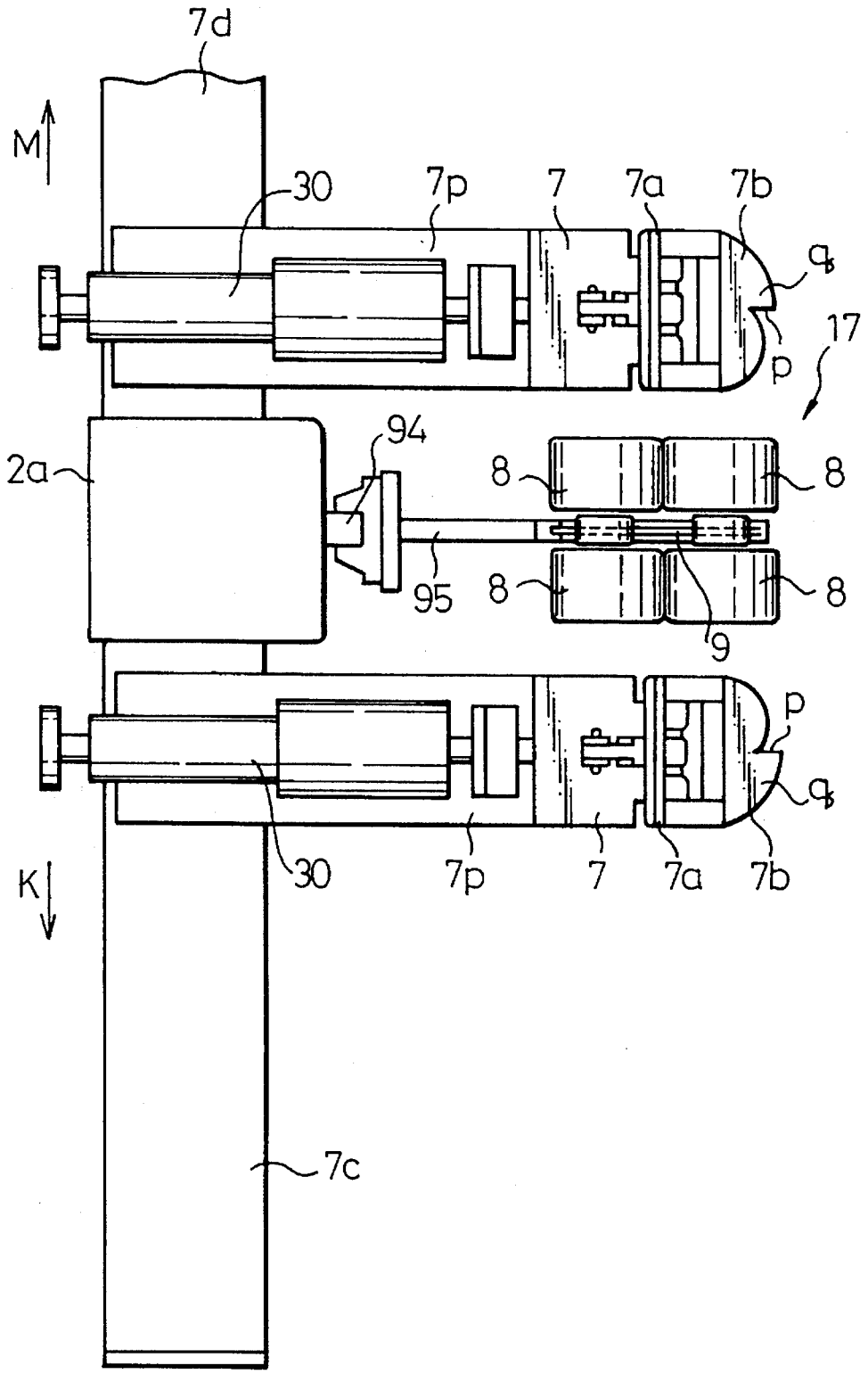
FIG. 4 is a plan view of the cutter unit and the lower grippers mounted to the front upright frame of FIGS. 1 and 2.
Figure 12:
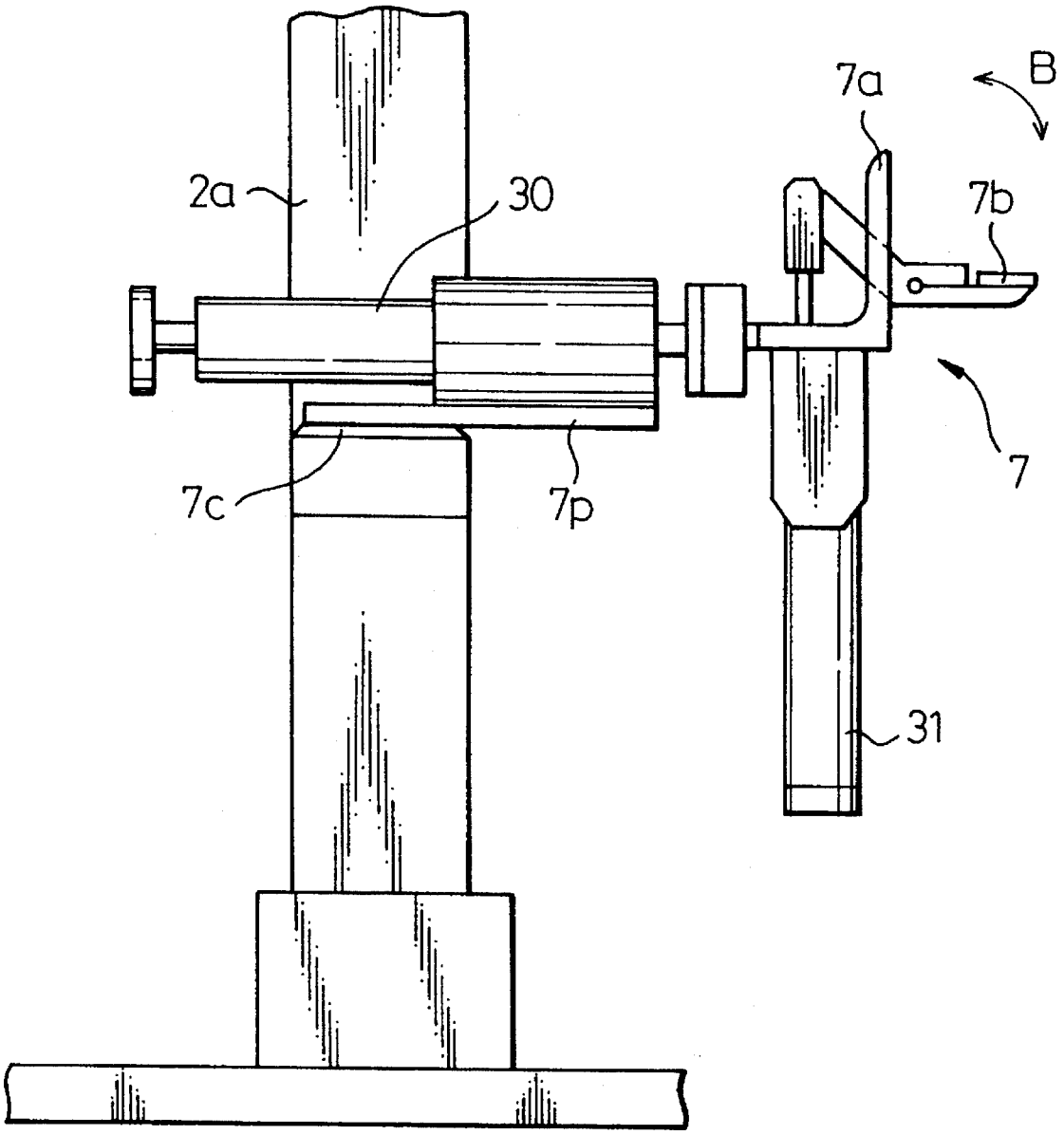
FIG. 12 is a side view of the lower gripper.
Figure 13:
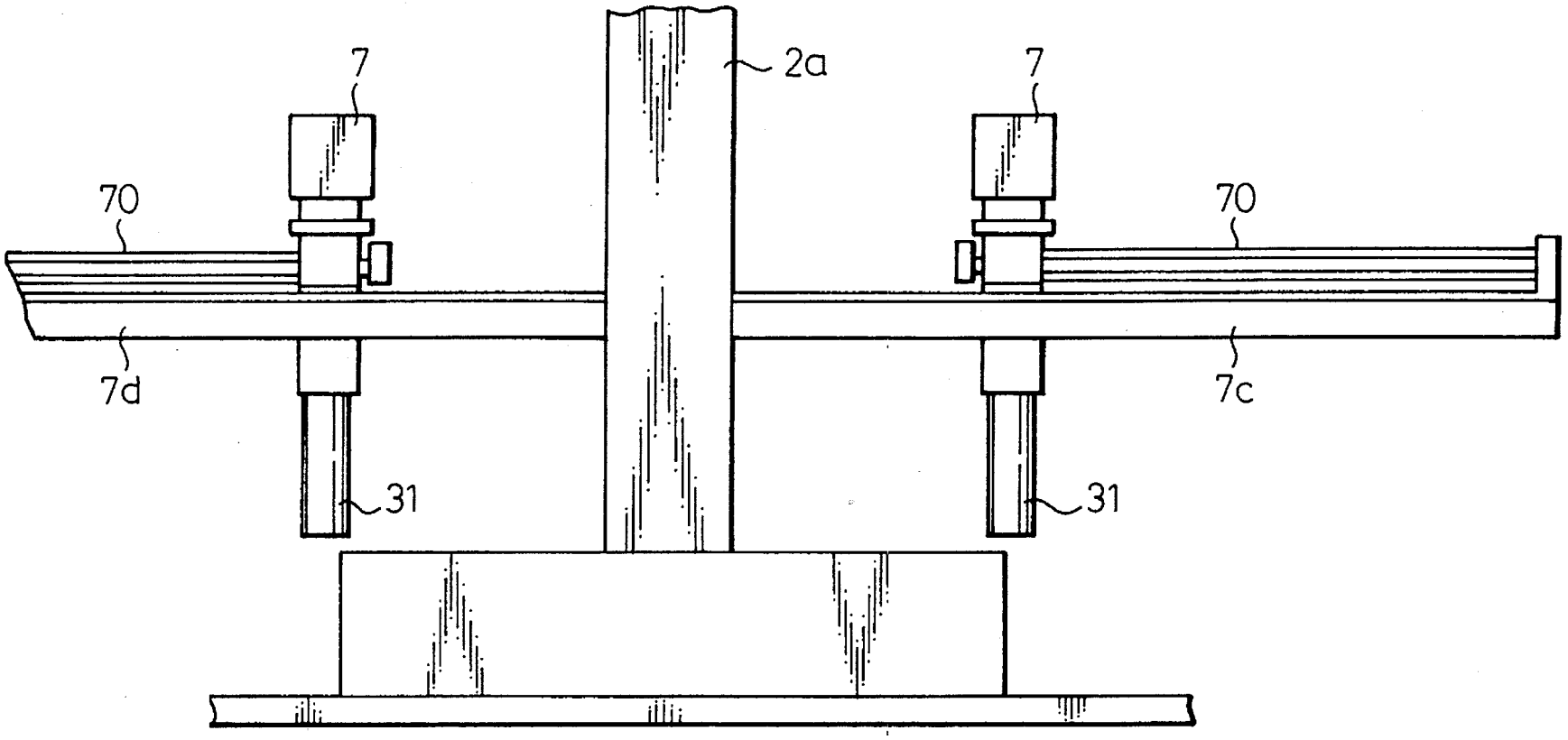
FIG. 13 is an enlarged front view of the lower grippers and the slide guide rails.

The front upright frame 2*a* includes two lower grippers 7, as shown in FIGS. 1 and 2, and in particular, in FIGS. 4, 12, and 13. Horizontal slide rails 7*c* and 7*d* are attached to the front upright frame 2*a* and extend parallel to the conveying direction of the conveyor 3. The lower grippers 7 are supported by support plates 7*p* which slidably engage with the slide rails 7*c* and 7*d*, respectively. Pneumatic cylinders 70 are attached to the slide rails 7*c* and 7*d* to move the lower grippers 7 in the conveying direction and in the opposite direction, as shown by the arrows K and M in FIG. 4. Each of the lower grippers 7 can move beyond the leading or trailing edge of the load L.

Each of the lower grippers 7 includes a pneumatic cylinder 30 to move the lower gripper 7 toward and away from the load L, as shown by the arrow A in FIG. 2. Each of the lower grippers 7 comprises a vertical stationary jaw 7*a* and a movable jaw 7*b*, as shown in FIG. 12. The movable jaw 7*b* is pivotably moved toward and away from the stationary jaw 7*a*, i.e., from the vertical position to the horizontal position, by a pneumatic cylinder 31, as shown by the arrow B. The movable jaw 7*b* is formed in a generally semicircular shape having a notch "p" and a piercing edge "q" adjacent to the notch "p", as shown in FIG. 4. This shape is especially useful when the movable jaw 7*b* pierces the film of the shrink-wrapped load L.

Figure 14:
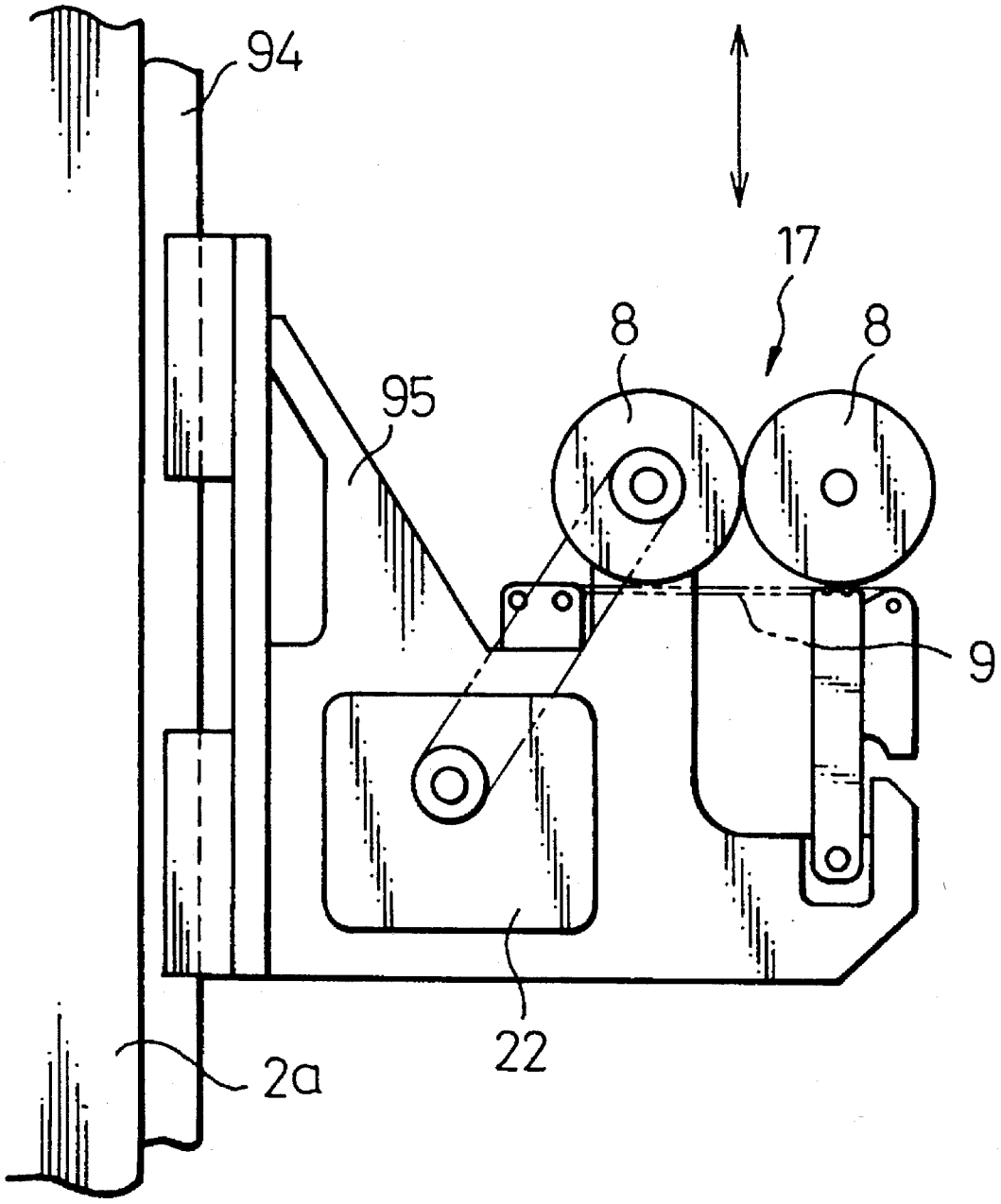
FIG. 14 is a side view of the cutter unit.

The front upright frame 2*a* also has a vertical guide rail 94 at the inner side thereof, as shown in FIGS. 2, 4 and 14. A cutter unit frame 95 is engaged with the guide rail 94 for vertical movement along the front upright frame 2*a*, as shown by the arrow C. An electric motor 21 (FIG. 1) moves the cutter unit frame 95 vertically via a chain or the like (not shown). A cutter unit 17 is mounted to the cutter unit frame 95 and includes two pairs of pinch rollers 8 and a heat cutter 9 between two pairs of pinch rollers 8. The cutter unit 17 is arranged between two lower grippers 7, and the two pairs of pinch rollers 8 are arranged just above the heat cutter 9. The contact area of the pinch rollers 8 of each pair extends generally on a line passing through the stationary jaws 7*a* of the lower grippers 7. Since the lower edge of the film 5 of the load L is rested against the stationary jaws 7*a* when the movable jaws 7*b* are moved toward the stationary jaws 7*a* to grip the film 5, one of each pair of pinch rollers 8 is positioned on the exterior side of the film 5 and the other roller 8 on the interior side of the film 5. An electric motor 22 drives the pinch rollers 8 via a belt.

Sensors 40 to 44 are provided for detecting the positions of the load L and the other elements. The sensors 40 to 44 comprise, for example, beam switches or limit switches. The sensor 40 detects that the load L reaches a predetermined unwrapping position between the front and rear upright frame 2*a* and 2*b*. The sensor 41 detects that the platen 6 presses the load L. The sensor 42 detects that the cutter unit 17 is at a predetermined lower position, the sensor 43 detects that the cutter unit 17 is below and near the top of the load L, and the sensor 44 detects that the cutter unit 17 moves above the top of the load L.

The operation of the unwrapping apparatus for unwrapping the stretch-wrapped load L is described first. The suction groove 52, the heat cutter 54, the rear suction pads 26 are not used when unwrapping the stretch-wrapped load L. The lower grippers 7 are not moved in the conveying direction.

The stretch-wrapped load L such as one shown in FIG. 23 is conveyed to the unwrapping position between the front and rear upright frames 2*a* and 2*b* by the conveyor 3. When the load L reaches this position, the lower grippers 7 and the cutter unit 17 are waiting in the position of FIGS. 2 and 4. The carriage 19 supporting the platen 6, the upper grippers 10, the main swing arms 11, and the auxiliary swing arms 50 are in the position of FIGS. 2 and 3.

When the load L arrives, the carriage 19 is moved downwards together with the platen 6 to press the top of the load L. The upper grippers 10 and the pins 51 are simultaneously lowered but located just above the top of the load L.

Figure 16A:
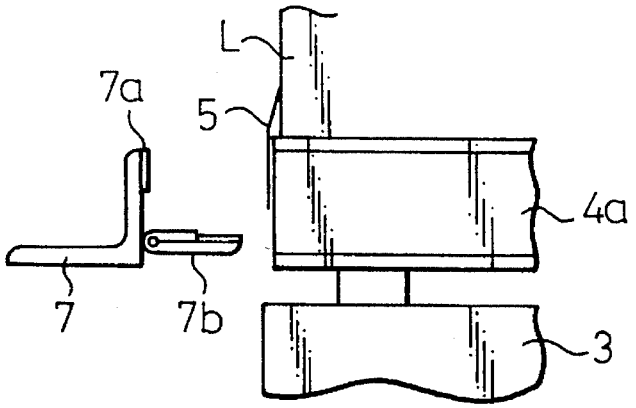
FIGS. 16A to 16D are views illustrating the operation of the lower gripper.
Figure 16B:
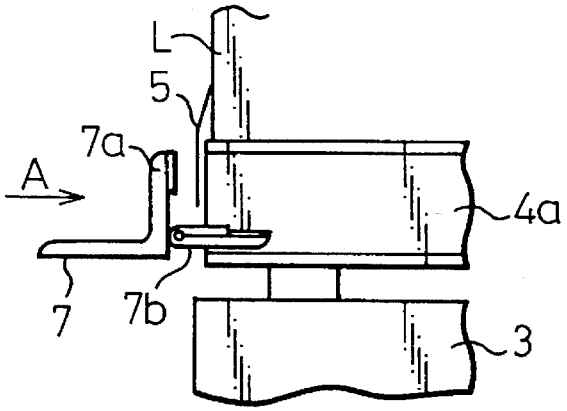
Figure 16C:
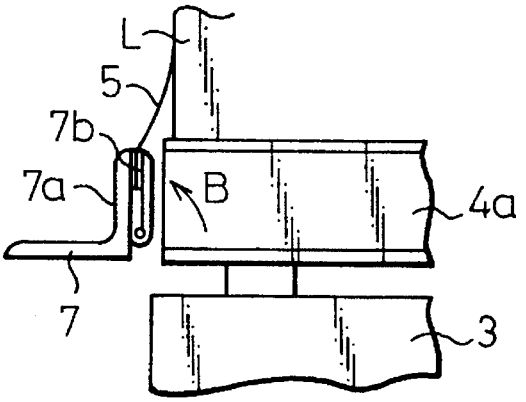
Figure 16D:
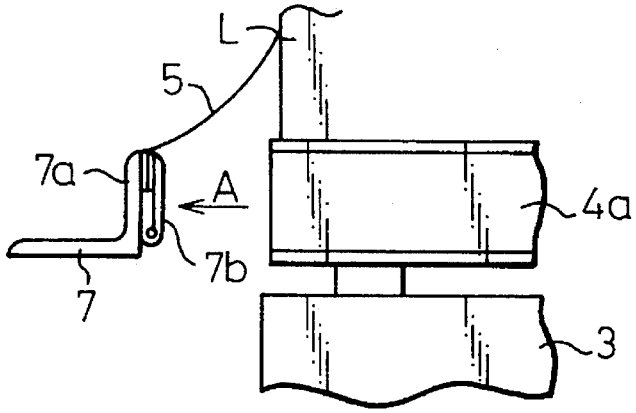

The movable jaws 7*b* of the lower grippers 7 are initially in the horizontal positions, as shown in FIG. 16A. The lower grippers 7 are moved toward and beyond the lower edge of the stretchable film 5 at the bottom of the load L, as shown in FIG. 16B. The movable jaws 7*b* of the lower grippers 7 then grip the lower edge of the film 5 between the movable jaws 7*b* and the stationary jaws 7*a*, as shown in FIG. 16C. The lower grippers 7 are then moved away from the load L to pull out the lower portion of the film 5 to the make a gap between the lower portion of the film 5 and the articles 4*b* and the pallet 4*a*, as shown in FIG. 16D.

The pinch rollers 8 are then started to rotate and the cutter unit 17 is moved upwards. The pinch rollers 8 thus pinch the film 5 from the exterior side of the film 5 and from the interior side of the film 5, and the heat cutter 9 cuts the film 5. The cutter unit 17 can move along a path spaced apart from the load L so that the pinch rollers 8 and the heat cutter 9 do not contact the article 4*b* while the pinch rollers 8 pull out the film 5.

The cutter unit 17 temporarily stops near the top of the load L. The platen 6 is moved slightly upwards and the upper grippers 10 are moved downwards to grip the upper edge of the film 5 at positions on the outside of the pinch rollers 8. The cutter unit 17 is then restarted to completely cut the film, and is stopped thereafter. The film is thus separated into the left and right portions along the cutting line. The film 5 is maintained under tension while the film 5 is being cut since the lower grippers 7 are gripping the lower edge of the film 5 and the upper grippers 10 are gripping the upper edge of the film 5.

Figures 17A, 17B, 17C:
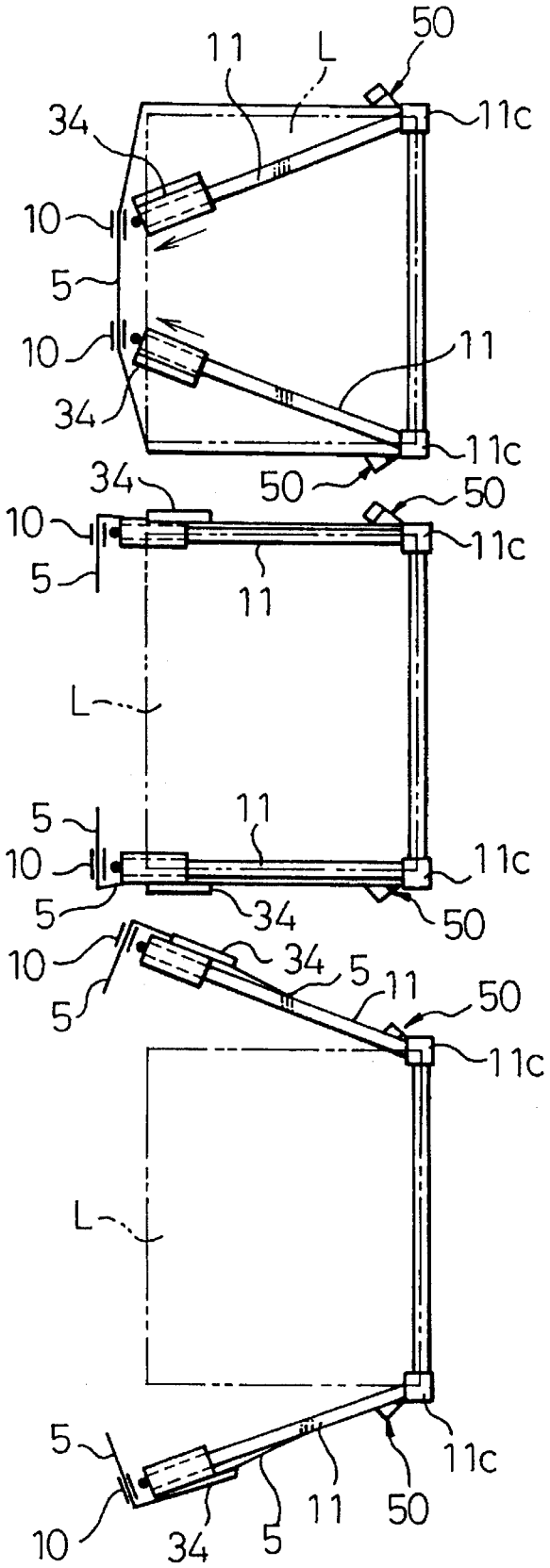
FIGS. 17A to 17C are views illustrating the operation of the upper grippers and swing arms.
Figure 18A:
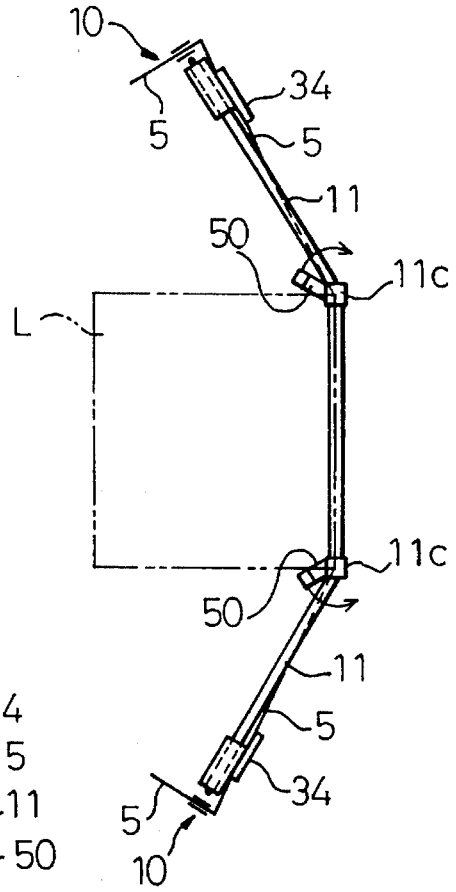
FIGS. 18A to 18C are views illustrating the subsequent operation of the upper grippers and swing arms.
Figure 18B:
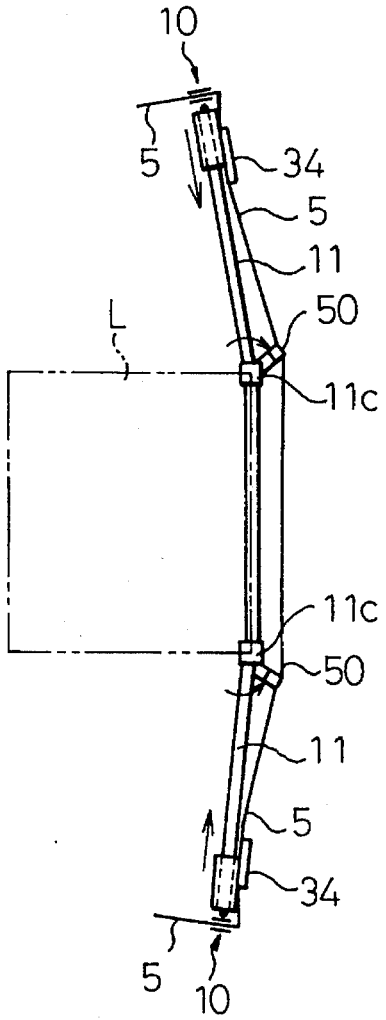
Figure 18C:
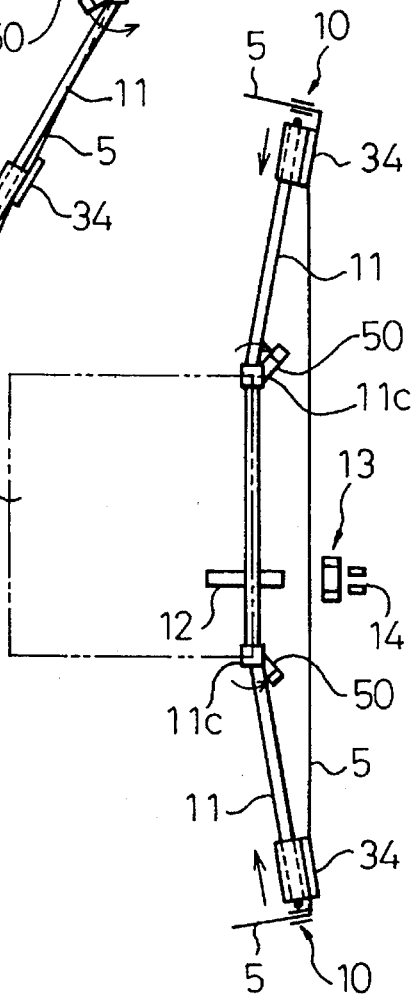

The lower grippers 7 then release the lower edge of the film 5 and the upper grippers 10 move upwards. Simultaneously, the main swing arms 11 start to swing to spread from each other, and the severed vertical edges of the film 5 are laterally opened at the front side of the load L to be separated from the front side of the load L, as shown in FIGS. 17A to 17C. In addition, the slidable gripper plates 91 on the free ends of the main swing arms 11 are extended, and the film 5 is stretched or pulled to maintain tension so as not to produce any shrinkage in the film 5 while the film 5 is separated from the front, lateral and rear sides of the load L, as shown in FIGS. 17B and 17C. The film 5 is maintained under tension without shrinkage until the swing arms 11 are finally swung to a position, as shown in FIG. 18C.

Figure 9A:
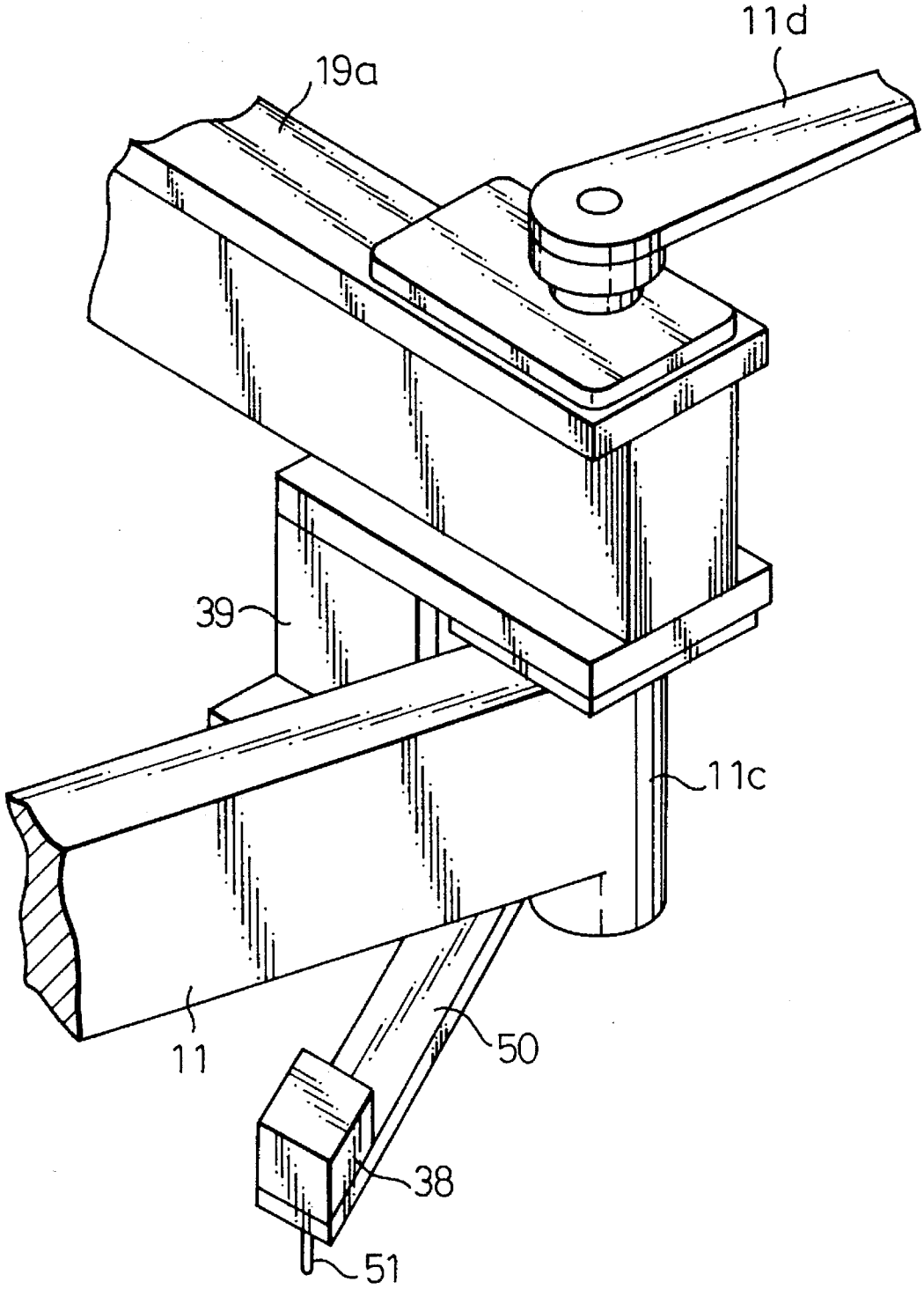
FIGS. 9A and 9B are perspective views of a portion of the main swing arm and the auxiliary swing arm in different conditions.
Figure 9B:
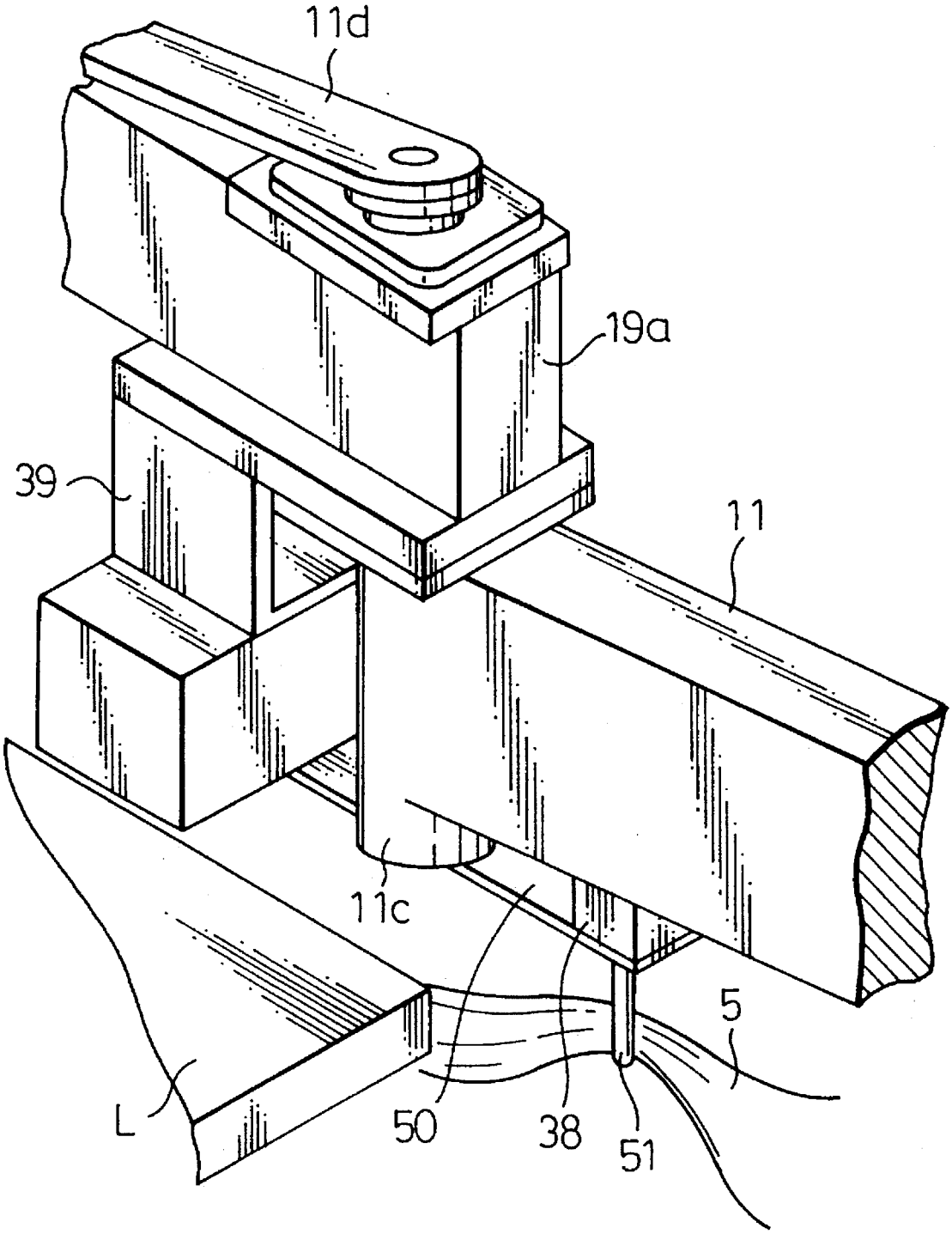

The auxiliary swing arms 50 are moved at an appropriate time after the main swing arms 11 start to swing. The main swing arms 11 are stopped once at an appropriate time, for example, in the step of FIG. 18A, in which each main swing arm 11 extends just beyond the pins 51 of the auxiliary swing arms 50. The pins 51 are then lowered and each pin 51 enters the gap between the upper edge of the film 5 and the load L near the rear upper corner thereof. The movement of the main swing arms 11 is then restarted and the auxiliary swing arms 50 are rotated, as shown in FIGS. 18A to 18C. The speed of the auxiliary swing arms 50 is higher than that of the main swing arms 11 and the auxiliary swing arms 50 are rotated more than 90 degrees. Accordingly, the pin 51 engages with the film 5 to separate the film 5 from the load L, as shown in FIG. 9B, while the main swing arms 11 are swinging and maintaining the tension in the film 5. The main swing arms 11 are further moved to the final position of FIG. 18C, and the slidable gripper plates 91 are retracted relative to the main swing arms 11. When the main swing arms 11 completely open the stretchable film 5, the auxiliary swing arms 50 and the platen 6 are returned to the respective initial positions.

In this way, the film 5 is fully separated from the load L without any shrinkage. If the film 5 suddenly shrinks during unwrapping, the articles **4*b* in contact with the film 5 may be moved or shifted by the shrunken film 5 and fall down out from the pallet 4*a* or the separate sheets 4*c*. According to the present invention, it is possible to prevent the articles 4*b* from falling down during unwrapping. The problem of the falling down of the articles 4*b* is more serious when a stretch-wrapped load is unwrapped than when a shrink-wrapped load is unwrapped, because the stretchable film 5 used in the stretch-wrapped load has a higher elasticity than the shrinkable film 5** used in the shrink-wrapped load and tends to suddenly shrink.

If the film 5 of a highly clinging type is used, there may be a problem that the film 5 is not easily separated from the upper grippers 10 when the upper grippers 10 are opened. However, this problem is solved by the movable jaws **10*a* and 10*b*** that are moved independently of and opposite to each other.

When the film 5 is fully separated from the load L, the rear gripper 25 is actuated to grip the upper edge of the film 5, and the upper gripper 10 releases the film 5. The pusher 12 is then moved to push the film 5 into the collecting guide 13 and the discharge nip rollers 14 may be driven to compress or squeeze the film 5 into a compact belt-like shape by which it can be easily disposed. The load L thus unwrapped is delivered from the unwrapping position to the next station by the conveyor 3 at an appropriate time after the end of the swing motion of the swing arms 11.

If the load L includes a top cover film on the top of the load L, the impulse heatsealer 15 is lowered and advanced toward the load L so that the stretchable film 5 wound around the peripheral of the load L and the top cover film are heatsealed together at an appropriate time, whereby it is possible to dispose of the film 5 and the top cover film together in a compact belt-like shape.

The operation of the unwrapping apparatus for unwrapping the shrink-wrapped load L is now described. Similarly to the above-described unwrapping operation, the shrink-wrapped load L such as the one shown in FIG. 24 or 25 is conveyed to the unwrapping position, and the carriage 19 is moved downwards together with the platen 6 to press the top of the load L. The movable jaws **7*b* of the lower grippers 7 are moved toward and beyond the lower edge of the shrinkable film 5 at the bottom of the load L, in a manner similar to that shown in FIG. 16B. However, in the case of the shrink-wrapped load L, the lower portion of the film 5 extends to the underside of the pallet 4*a*, as shown in FIG. 19, and the movable jaws 7*b* must pierce into the film 5. Since the movable jaws 7*b* are formed in a generally semi-circular shape having a notch "p" and a piercing edge "q" adjacent to the notch "p", as shown in FIG. 4, the movable jaws 7*b* can easily pierce into the film 5. The movable jaws 7*b* are then operated to grip the film 5, in a manner similar to that shown in FIG. 16C. The lower grippers 7 are then retracted to make a gap between the lower portion of the film 5 and the articles 4*b* and the pallet 4*a***, in a manner similar to that shown in FIG. 16D.

During the operation of the lower grippers 7, the vacuum is introduced from the vacuum source into the Z-shaped suction groove 62 provided on the lower surface of the platen 6 to pick up the film 5 on the top of the load L, as shown in FIG. 7. The platen 6 is moved to an appropriate distance so as to make a gap between the film 5 and the load L. The operation of the platen 6 can be controlled by appropriate means such as a timer. The heat cutter 53 is then lowered until it contact the film 5, and a current is supplied to the heat cutter 53 to cut the film 5 in the Z-shape. Then, the vacuum is shut off and the heat cutter 53 is raised to the initial position.

The cutter unit 17 is operated, similarly to the above-described operation. That is, the pinch rollers 8 pinch the film 5 from the exterior side and the interior side of the film 5, and the heat cutter 9 cut the film 5 at the front side of the load L. The cutter unit 17 is temporarily stopped and the upper grippers 10 are moved downwards. Since the top of the film 5 was cut in the Z-shape and the upper grippers 10 are located at positions shown by the broken line in FIG. 5, the upper grippers 10 can grip the outer rim portion of the top of the film 5 on the front side of the first portion **52*a* of the suction groove 52. The cutter unit 17 is then restarted to completely cut the film 5 along the vertical center line at the front side of the load. The outer rim portion of the top of the film 5 is also cut along the line P shown in FIG. 5**.

Accordingly, the film 5 can be opened and spread into two parts except for the rear side thereof, by the swing motion of the swing arms 11 and the auxiliary swing arms 50, in a manner similar to the operation of FIGS. 17A to 18C. However, since the shrinkable film 5 is less elastic than the stretchable film, the slidable gripper plate 91 on the free ends of the main swing arms 11 are not extended, in the step of FIG. 17B. The extension of the slidable gripper plate 91 is not appropriate in this case, because the Z-shaped slit on the top of the film 5 may be undesirably widened.

The lower grippers 7 maintain a grip on the lower edge of the film 5 during the swing motion of the swing arms 11 in the step of FIGS. 17A to 17C. The lower grippers 7 are moved along the slide rails **7*c* and 7*d* by the pneumatic cylinders 70 in the conveying direction and in the opposite direction, as shown by the arrows K and M in FIG. 4. Each of the lower grippers 7 can move beyond the leading or trailing edge of the load L so as to detach the lower edge of the film 5, that is held in the front corners of the pallet 4***a*, from the latter. The lower grippers 7 then release the film 5 and the swing motion of the swing arms 11 is continued, as shown in FIGS. 18A to 18C.

The rear suction cups 26 are also operated to hold the film 5 and move back so as to detach the lower edge of the film 5, that is held at the rear corners of the pallet 4*a*, from the latter. Accordingly, it is possible to fully separate the film 5 from the load L when the swing arms 11 complete the swing motion.

When the film 5 is fully separated from the load L, the rear gripper 25 is actuated to grip the upper edge of the film 5, and the upper gripper 10 releases the film 5. The action of the rear gripper 25 is especially useful when the shrink-wrapped load L is unwrapped, because the film 5 includes the Z-shaped slit which may be widened during the swing motion of the swing arms 11 and center of the film 5 may hang in such a manner that the discharge pusher 12 cannot push the film 5 into the collecting guide 13. The rear gripper 25 can be moved down to catch the hanging film 5 and moved up to a position so that the discharge pusher 12 can push the film 5 into the collecting guide 13. The pusher 12, the collecting guide 13, and the discharge nip rollers 14 are used in a manner described above to compress or squeeze the film 5 into a compact belt-like shape by which it can be easily disposed of. The heatsealer 15 is not used in this case.

Figure 20:
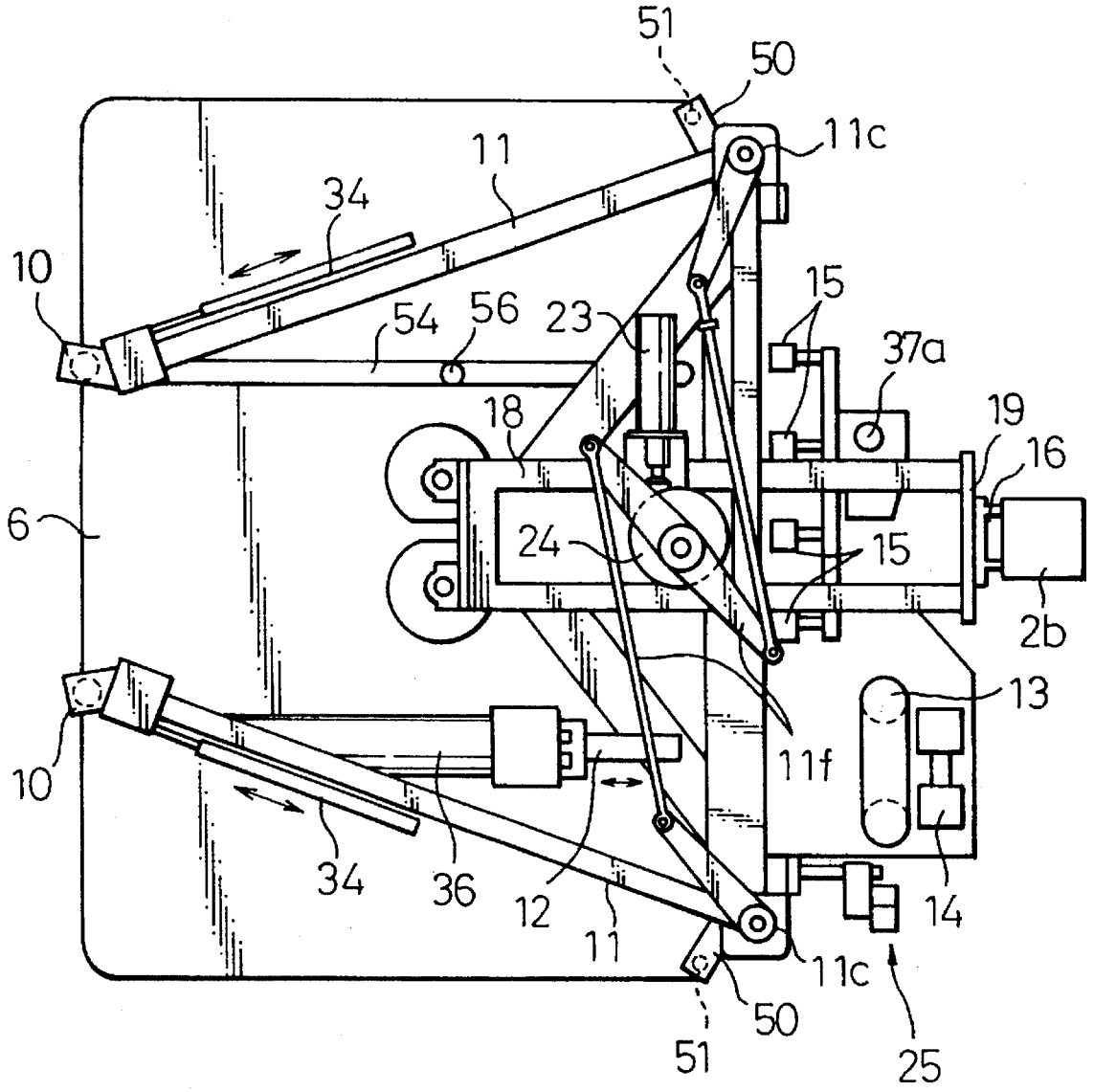
FIG. 20 is a plan view of the carriage mounted on the unwrapping apparatus according to the second embodiment of the present invention.
Figure 21:
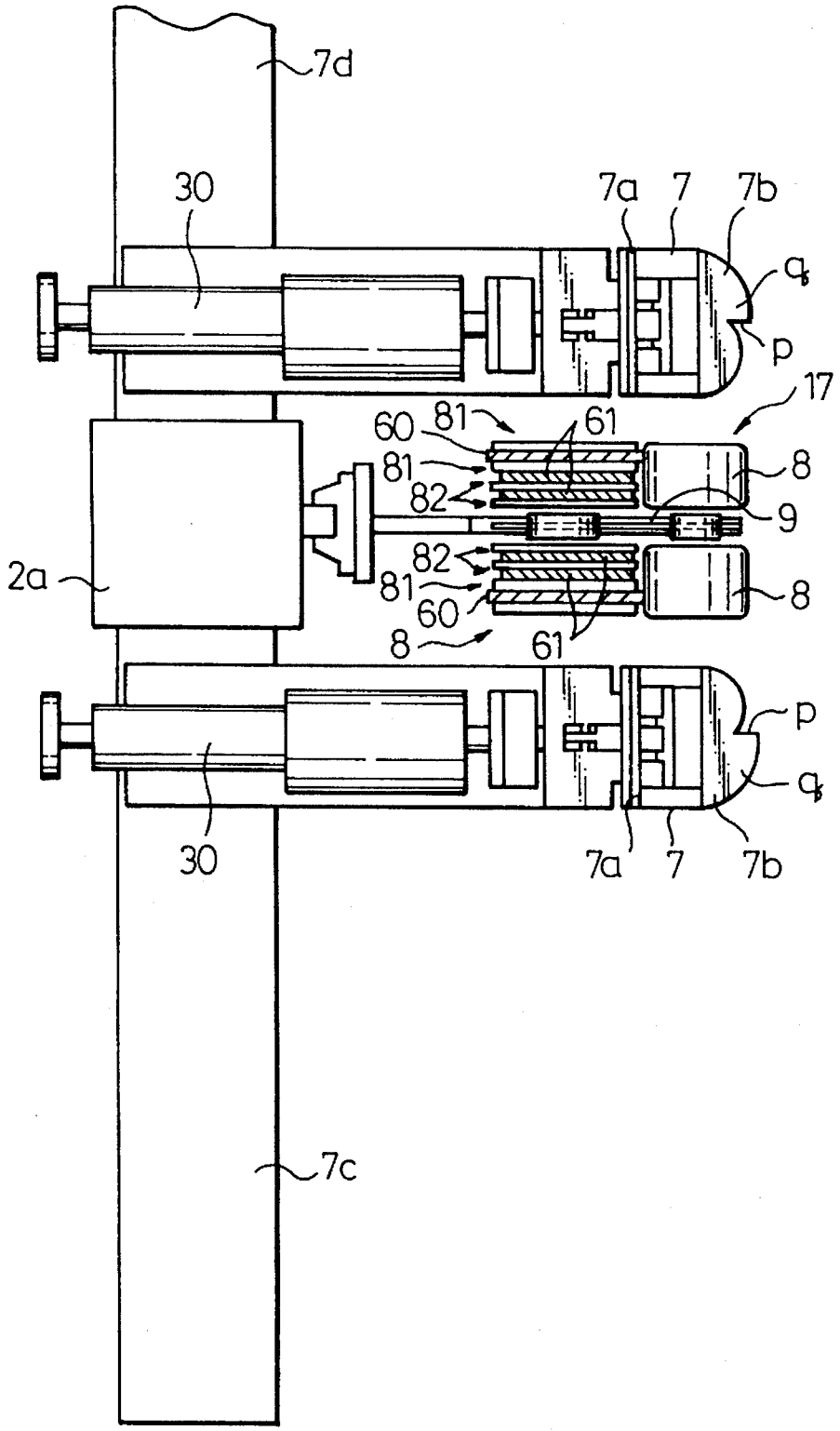
FIG. 21 is a plan of the cutter unit and the lower grippers of the second embodiment.
Figure 22:
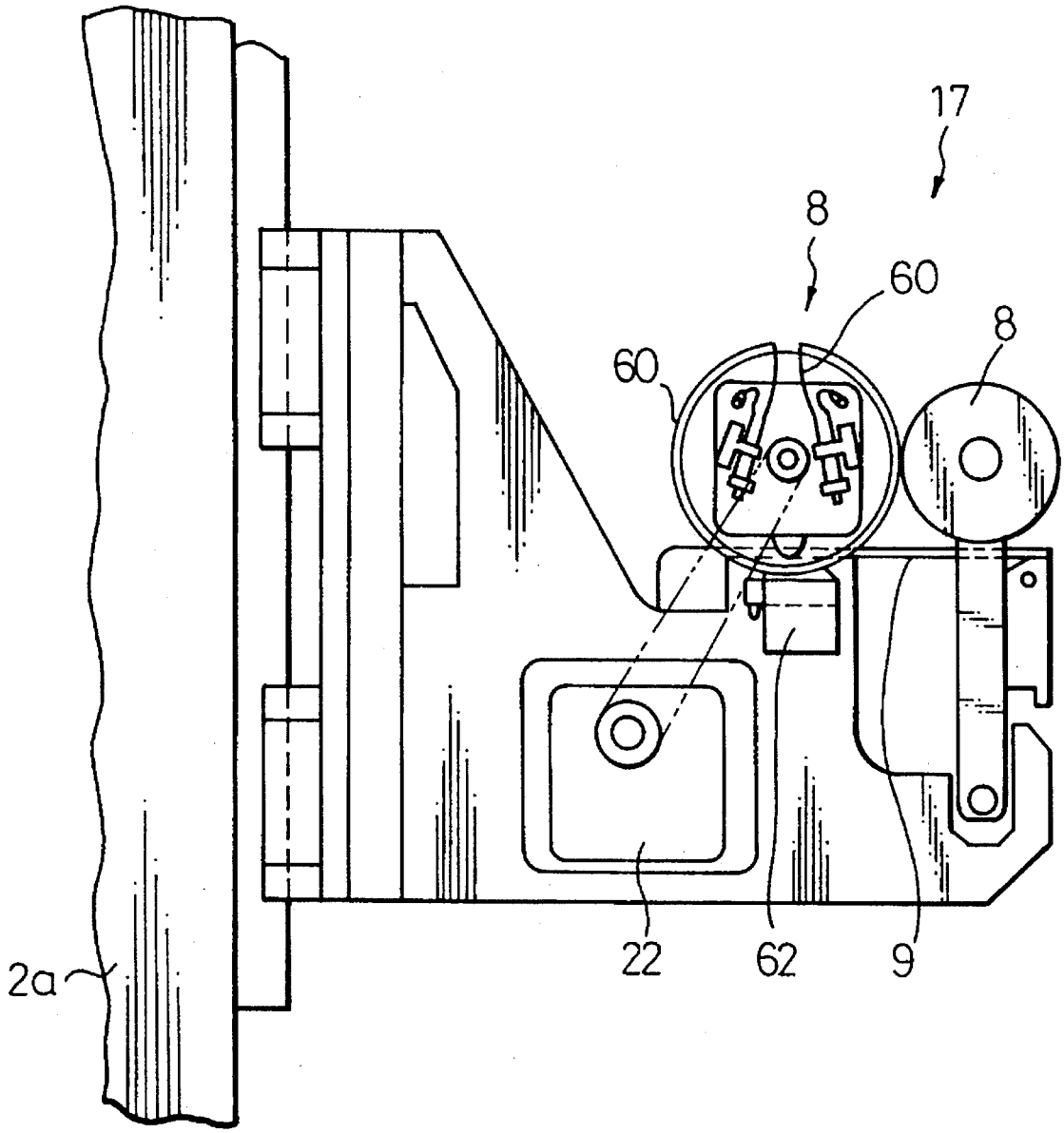
FIG. 22 is a side view of the cutter unit of FIG. 21.

The second embodiment of the present invention will be described with reference to FIGS. 20 to 22. The carriage 19 of FIG. 20 and the cutter unit 17 of FIGS. 21 and 22 can be mounted to the unwrapping apparatus of FIGS. 1 to 19. This carriage 19 in this embodiment includes an electric motor, or a servo motor 23, a reduction gear device 24 and a pivot lever mechanism 11*e* for actuating the main swing arms 11, in place of the pneumatic cylinders 35 in the previous embodiment. By using the servo motor 23 for actuating the main swing arms 11, it is possible not only to freely select the speed of the swing motion (constant rotational speed) of the main swing arms 11, but also to change the speed during the swing motion of the main swing arms 11, as desired, for cooperation with the swing motion of the auxiliary swing arms 50. It is also possible to temporarily stop the swing motion of the main swing arms 11 as desired.

When a non-cling type film rather than a cling type film is used for the stretchable film 5, multiple turns of strips of the stretchable film 5 wound around the load L in a spiral pattern are not joined to each other, and may be separated into the respective strips when the stretchable film 5 is cut and then pushed into the ring-like collective guide 13 after the unwrapping. Such separated stretchable film 5 may hinder the continuous operation of the unwrapping apparatus.

This embodiment solves this problem. In this embodiment, the cutter unit 17 includes two pairs of pinch rollers 8, the electric wire cutter 9, and a heater for heatsealing the film 5 incorporated in one of each pair of nip rollers 8 located on the exterior side of the film 5 to heatseal the film 5 along two continuous lines on either side of the cutting line to join the multiple turns of strips of the film 5 together. For this purpose, the pinch roller 8 on the exterior side of the film 5 comprises a plurality of different nylon disks to form a large diameter portion 81 and small diameter portions 82. Nichrome wire 60 is arranged on the peripheral surface of the large diameter portion 81 and a layer of polytetrafluoroethylene covers the Nichrome wire 60. Slip rings 61 are arranged on the small diameter portions 82 for supplying the power to the Nichrome wire 60, and power supply contacts 62 are arranged below that pinch roller 8 in contact with the slip rings 61. In addition, the other pinch roller 8 on the interior side comprises a nylon roller which is covered by a layer of silicon rubber and a layer of polytetrafluoroethylene.

We claim:

1. An unwrapping apparatus for unwrapping a load with articles and a film wrapping the articles, said unwrapping apparatus comprising:

front and rear upright frames arranged in a spaced relationship, said front and rear upright frames defining a first line extending therebetween and a second line perpendicular to the first line;

means for conveying a load to be unwrapped at an unwrapping position between the front and the rear upright frames;

lower grippers arranged on or near the front upright frame for gripping a lower edge of a film of the load;

means for supporting the lower grippers for movement along said second line;

a cutter unit arranged on the front upright frame for vertical movement along the front upright frame for cutting the film;

a carriage arranged on the rear upright frame for vertical movement along the rear upright frame and having a platen for stabilizing the load while being unwrapped the platen having a front side near the front upright frame and a rear side near the rear upright frame;

a suction groove arranged in said platen to retain the film on the top of a load, the suction groove having at least a first portion arranged near the front side thereof in pallalel to said second line and a second portion extending from the first portion toward the rear side thereof;

a heat cutter arranged in said platen along the suction groove to cut the top of the film held by the suction groove;

a pair of symmetrical swing arms arranged above the platen with pivot ends near the rear upright frame and free ends near the front upright frame;

an upper gripper arranged on the free end of each of the swing arms for gripping an upper edge of the film, whereby the film that is cut by the cutter unit and gripped by the upper grippers is spread and separated from the load during a swing motion of the swing arms.

2. An unwrapping apparatus according to claim 1, wherein two lower grippers are arranged on the front upright frame in a horizontally side by side relationship for gripping a lower edge of the film on the load to be unwrapped;

the cutter unit being arranged on the front upright frame between two lower glippers and having two pairs of pinch rollers with one of each pair of pinch rollers positionable on the exterior side of the film and the other on the interior side of the film to grip the film therebetween, and a cutter arranged between the two pairs of pinch rollers;

the carriage including a support portion extending parallel to said second line, the support portion carrying the swing arms; and wherein each of the lower grippers is movable toward and away from the load and comprising a stationary jaw and a movable jaw, the movable jaw being formed in a generally semi-circular shape having a notch and a piercing edge adjacent to the notch.

3. An unwrapping apparatus according to claim 1, further comprising suction means arranged on or near the rear upright frame for pulling the rear bottom portions of the film to separate the latter from the load.

4. An unwrapping apparatus according to claim 1, further comprising a rear gripper arranged onto the carriage near the pivot end of one of the swing arms for gripping an upper edge of the film of the load, a ring-shaped collecting guide for collecting the film therein that is removed from the load, a pusher for pushing the film into the collecting guide, and discharge nip rollers arranged on the outlet side of the collecting guide to continuously compress and discharge the film pushed into the collecting guide.

5. An unwrapping apparatus according to claim 1, further comprising a heatsealer arranged onto the carriage to heat-seal and join together a top cover film and the stretchable film.

6. An unwrapping apparatus according to claim 1, wherein the cutter unit is arranged on the front upright frame between the two lower grippers for upward and downward movement, the cutter unit comprising two pairs of pinch rollers with one of each pair of pinch rollers positionable on the exterior side of the film and the other on the interior side of the film to grip the film therebetween, and a cutter arranged between the two pairs of pinch rollers for cutting the film, the pinch rollers that are positionable on the exterior side of the film having a heater for heatsealing the film.

7. An unwrapping apparatus according to claim 1, further comprising auxiliary film separating means arranged near the pivot ends of the swing arms for separating the film from the upper rear portions of the load while being unwrapped.

8. An unwrapping apparatus according to claim 1, wherein each of the upper grippers comprises a pair of cooperating jaws which are independently movable in relation to each other.

9. An unwrapping apparatus according to claim 1, wherein said suction groove is formed in one of a Z-shape, an H-shape and a T-shape.

* * * * *